US011014369B2

(12) United States Patent
Oya et al.

(10) Patent No.: US 11,014,369 B2
(45) Date of Patent: May 25, 2021

(54) CARTRIDGE AND LIQUID EJECTING SYSTEM

(71) Applicant: SEIKO EPSON CORPORATION, Tokyo (JP)

(72) Inventors: Shun Oya, Kiso-machi (JP); Yoshihiro Koizumi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/774,378

(22) Filed: Jan. 28, 2020

(65) Prior Publication Data

US 2020/0238719 A1 Jul. 30, 2020

(30) Foreign Application Priority Data

Jan. 29, 2019 (JP) ..... JP2019-012824

(51) Int. Cl.
*B41J 2/175* (2006.01)

(52) U.S. Cl.
CPC ..... *B41J 2/17526* (2013.01); *B41J 2/175* (2013.01); *B41J 2/1752* (2013.01); *B41J 2/1753* (2013.01); *B41J 2/17509* (2013.01); *B41J 2/17513* (2013.01); *B41J 2/17553* (2013.01)

(58) Field of Classification Search
CPC .. B41J 2/17526; B41J 2/17509; B41J 2/1752; B41J 2/17553; B41J 2/1753; B41J 2/175; B41J 2/17513
See application file for complete search history.

(56) References Cited

U.S. PATENT DOCUMENTS 9,233,546 B2 * 1/2016 Oya ..... B41J 2/17553
2013/0182051 A1 7/2013 Aoki et al.

FOREIGN PATENT DOCUMENTS

JP 2018-118522 A 8/2018
WO WO-2013/105504 A1 7/2013

* cited by examiner

*Primary Examiner* — Geoffrey S Mruk
(74) *Attorney, Agent, or Firm* — Oliff PLC

(57) ABSTRACT

A cartridge has a terminal disposition wall portion where a plurality of cartridge side terminals are disposed so as to form an inclined surface facing a direction including a components in −Y and +Z directions. The terminal disposition wall portion includes a first protruding portion and a second protruding portion provided further in the −Y direction than a second wall constituting a pressurization chamber, a first extending portion extending in the −Y direction from the first protruding portion, and a second extending portion extending in the −Y direction from the second protruding portion. A first cartridge side contact portion configured to come into contact with a first apparatus side contact portion is provided in the first extending portion. A second cartridge side contact portion configured to come into contact with a second apparatus side contact portion is provided in the second extending portion.

7 Claims, 12 Drawing Sheets

CARTRIDGE AND LIQUID EJECTING SYSTEM

CROSS REFERENCES TO RELATED APPLICATIONS

The entire disclosure of Japanese Patent Application No. 2019-012824, filed Jan. 29, 2019 is incorporated by reference herein.

BACKGROUND

1. Technical Field

The present disclosure relates to a cartridge and a liquid ejecting system constituted by a cartridge and a liquid ejecting apparatus in which the cartridge is mounted.

2. Related Art

Known in the related art is a pressurization-type liquid ejecting system constituted by a liquid ejecting apparatus having a liquid ejecting head ejecting a liquid and a cartridge mounted in the liquid ejecting apparatus and storing a liquid that is supplied to the liquid ejecting head.

In the pressurization-type liquid ejecting system, the liquid ejecting apparatus is provided with a cartridge mounting portion in which the cartridge is mounted and a pressurization mechanism capable of supplying a pressurized fluid to the cartridge mounted in the cartridge mounting portion. The cartridge is provided with a case having a pressurization chamber to which the pressurized fluid is supplied and a liquid accommodating body disposed in the pressurization chamber and accommodating a liquid. The cartridge is mounted in the liquid ejecting apparatus by being inserted into the cartridge mounting portion along a mounting direction.

International Publication No. 2013/105504 discloses an example of such cartridges. The cartridge that is disclosed in International Publication No. 2013/105504 is equipped with a circuit substrate storing information related to a liquid accommodated in a liquid accommodating body. The cartridge that is disclosed in International Publication No. 2013/105504 is equipped with the circuit substrate as illustrated in FIG. 16.

A cartridge 250 has a recessed portion 252 for a substrate in the corner portion of a case 251 in the −Y direction, which is a mounting direction, as illustrated in FIG. 16. A circuit substrate 253 is disposed between a pair of side wall portions 254 and 255 constituting the recessed portion 252 for a substrate. The circuit substrate 253 is housed in the recessed portion 252 for a substrate in a state of being inclined such that a surface 257 where a plurality of cartridge side terminals 256 electrically coupled to apparatus side terminals are formed is exposed and that the surface 257 is in a direction intersecting with the −Y direction with the part that is closer to the front in the −Y direction positioned on the lower side. The pair of side wall portions 254 and 255 have positioning grooves 259 and 260, respectively. Each of the positioning grooves 259 and 260 is an opening in a front surface 258 of the case 251, which extends in the +Y direction. The cartridge 250 is positioned by a pair of positioning portions (not illustrated) of a cartridge mounting portion being inserted into the positioning grooves 259 and 260, and the cartridge side terminals 256 are electrically coupled to the apparatus side terminals.

In the configuration described in International Publication No. 2013/105504, the relative positions of the positioning grooves 259 and 260 and the circuit substrate 253 may be misaligned when the case 251 is deformed by a pressurization chamber being pressurized by a pressurization mechanism. Then, a contact failure may occur between the apparatus side terminals and the cartridge side terminals 256.

SUMMARY

A cartridge for solving the above problems is mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge includes a plurality of cartridge side terminals configured to be electrically coupled to the plurality of apparatus side terminals, a pressurization chamber supplied with the pressurized fluid, a terminal disposition wall portion where the plurality of cartridge side terminals are disposed, a first cartridge side contact portion configured to come into contact with the first apparatus side contact portion, and a second cartridge side contact portion configured to come into contact with the second apparatus side contact portion. A plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction. The pressurization chamber has a plurality of walls including a first wall positioned in the +Z direction and a second wall positioned in the −Y direction. The terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion. The first cartridge side contact portion is provided in the first extending portion. The second cartridge side contact portion is provided in the second extending portion.

A cartridge for solving the above problems is mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge includes a plurality of cartridge side terminals configured to be electrically coupled to the plurality of apparatus side terminals, a pressurization chamber supplied with the pressurized fluid, a terminal disposition wall portion where the plurality of cartridge side terminals are disposed, a first cartridge side contact portion configured to come into contact with the first apparatus side contact portion, and a second cartridge side contact portion configured to come into contact with the second apparatus side contact portion. A plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction. The pressurization chamber has a plurality of walls including a first wall positioned in the +Z direction and a second wall positioned in the −Y direction. The terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion. The first cartridge side contact portion is provided in the −X direction of the first protruding portion and in the −Z direction of the first extending portion. The second cartridge side contact portion is provided in the +X direction of the second protruding portion and in the −Z direction of the second extending portion.

A liquid ejecting system for solving the above problems includes a liquid ejecting apparatus and the cartridge described above. The liquid ejecting apparatus is provided, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge is mounted in the liquid ejecting apparatus by being moved from the +Y direction toward the −Y direction.

DESCRIPTION OF EXEMPLARY EMBODIMENTS

First Embodiment

A cartridge and a liquid ejecting system of a first embodiment will be described with reference to the drawings. The cartridge is mounted in a liquid ejecting apparatus such as an ink jet printer that prints a character, an image, or the like on a medium by ejecting ink as an example of a liquid onto the medium such as paper. The cartridge and the liquid ejecting apparatus constitute the liquid ejecting system.

Figure 1:
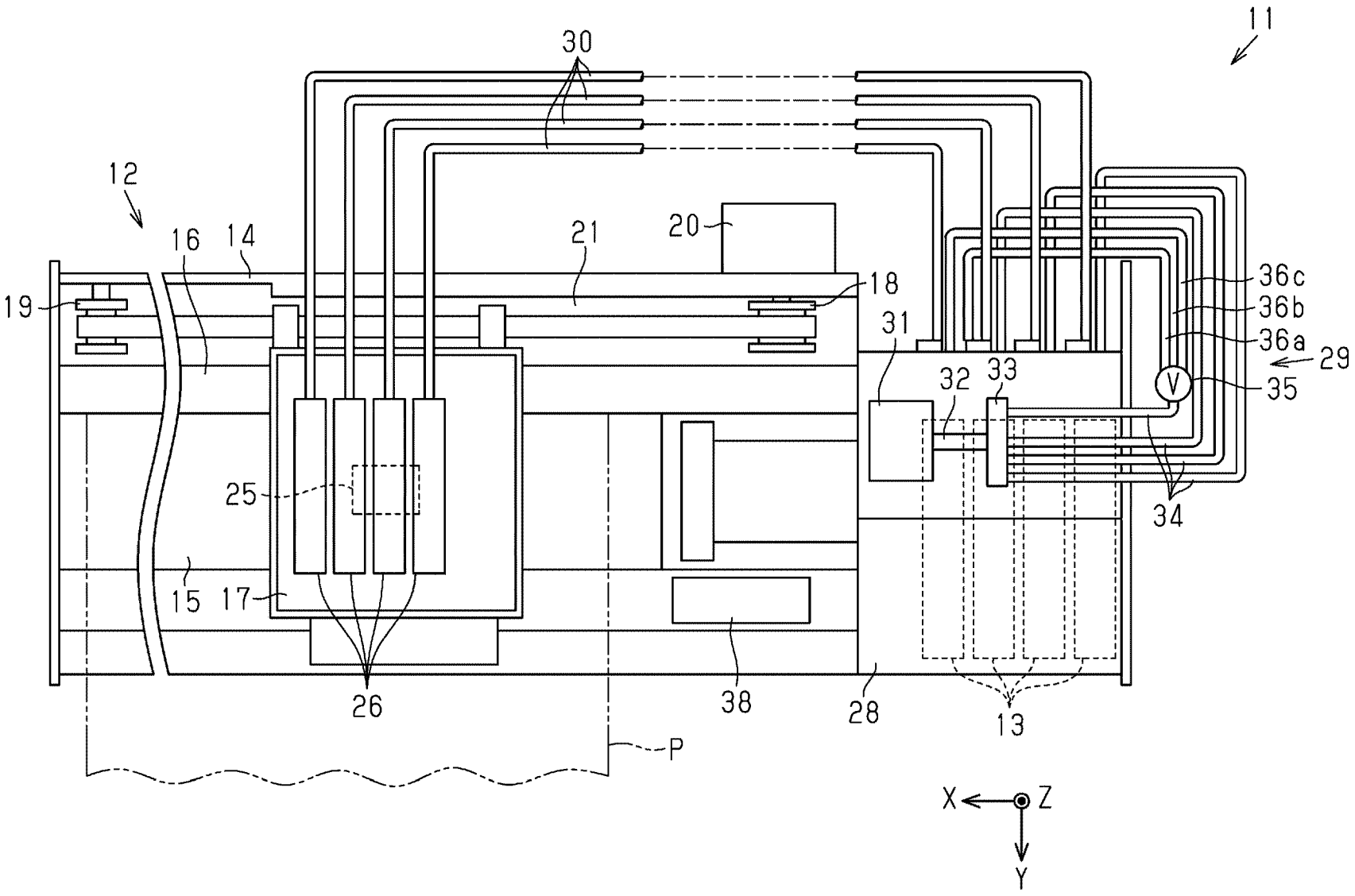
FIG. 1 is a diagram illustrating a schematic configuration of a liquid ejecting system of an embodiment in a first embodiment.

FIG. 1 is a diagram illustrating a schematic configuration of the liquid ejecting system of an embodiment. The X axis, the Y axis, and the Z axis in FIG. 1 are three spatial axes mutually orthogonal to one another. The directions indicated by the arrows indicating the X axis, the Y axis, and the Z axis indicate positive directions along the X axis, the Y axis, and the Z axis, respectively. The positive directions along the X axis, the Y axis, and the Z axis are indicated as a +X direction, a +Y direction, and a +Z direction, respectively. The directions opposite to the directions indicated by the arrows indicating the X axis, the Y axis, and the Z axis are negative directions along the X axis, the Y axis, and the Z axis, respectively. The negative directions along the X axis, the Y axis, and the Z axis are indicated as a −X direction, a −Y direction, and a −Z direction, respectively. The directions that are along the X axis, the Y axis, and the Z axis regardless of being positive or negative will be referred to as an X direction, a Y direction, and a Z direction, respectively. The XYZ axes drawn in the other drawings correspond to the XYZ axes in FIG. 1. In a state where a liquid ejecting system 11 is used after installation on a horizontal plane including the X direction and the Y direction, the +Z direction is the vertically upward direction of the liquid ejecting system 11 and the −Z direction is the vertically downward direction of the liquid ejecting system 11.

As illustrated in FIG. 1, the liquid ejecting system 11 is provided with a liquid ejecting apparatus 12 and a cartridge 13 mounted in the liquid ejecting apparatus 12. A plurality of cartridges may be mounted in the liquid ejecting apparatus. Mounted in the liquid ejecting apparatus 12 of the present embodiment are four cartridges 13 accommodating inks with different properties such as inks of different colors, examples of which include cyan, magenta, yellow, and black.

The liquid ejecting apparatus 12 has a box-shaped main body case 14, a support base 15, a guide shaft 16, a carriage 17, a driving pulley 18, a driven pulley 19, and a carriage motor 20.

The support base 15 extends in the X direction in the main body case 14 and supports recording paper P from below. The recording paper P is fed onto the support base 15 by a paper feed mechanism (not illustrated) and in a sub-scanning direction orthogonal to a main scanning direction, which is the direction of movement of the carriage 17. In the liquid ejecting apparatus 12, the main scanning direction is set to the X direction and the sub-scanning direction is set to the Y direction.

The guide shaft 16 is positioned in the +Z direction relative to the support base 15. The guide shaft 16 is a rod-shaped member extending in the X direction, which is the main scanning direction. The guide shaft 16 supports the carriage 17 so as to be movable along the guide shaft 16. The driving pulley 18 is positioned in the −Y direction relative to the end portion of the guide shaft 16 in the −X direction. The driving pulley 18 is provided so as to be rotatable around the Y direction as an axis. The driven pulley 19 is positioned in the −Y direction relative to the end portion of the guide shaft 16 in the +X direction. The driven pulley 19 is provided so as to be rotatable around the Y direction as an axis. The output shaft of the carriage motor 20 is coupled to the driving pulley 18. An endless timing belt 21 supporting the carriage 17 is wound around the driving pulley 18 and the driven pulley 19. The carriage 17 is configured to be capable of reciprocating along the guide shaft 16 by the carriage motor 20 being driven.

The carriage 17 is equipped with a liquid ejecting head 25 and a valve unit 26. The liquid ejecting head 25 is positioned in the −Z direction relative to the carriage 17. The liquid ejecting head 25 ejects ink onto the recording paper P supported by the support base 15. The valve unit 26 is provided in the +Z direction relative to the liquid ejecting head 25. The valve unit 26 stores the ink that is ejected from the liquid ejecting head 25. The carriage 17 of the present embodiment is equipped with four valve units 26 so as to correspond to the respective cartridges 13.

The liquid ejecting apparatus 12 has a cartridge mounting portion 28, a pressurization mechanism 29, and an ink flow path 30. The cartridge 13 is mounted in the cartridge mounting portion 28. The cartridges 13 mounted in the cartridge mounting portion 28 are separately supplied with a pressurized fluid by the pressurization mechanism 29. The ink flow paths 30 separately couple the cartridges 13 and the valve units 26. In the liquid ejecting apparatus 12, the pressurization mechanism 29 supplies the pressurized fluid to each of the cartridges 13 mounted in the cartridge mounting portion 28. As a result, ink is supplied to the valve unit 26 through the ink flow path 30.

The pressurization mechanism 29 is disposed in the main body case 14. The pressurization mechanism 29 has a pressurization pump 31, a common flow path 32, a distributor 33, and a distribution flow path 34. The pressurization pump 31 generates a pressurized fluid by compressing air in the atmosphere. The upstream end of the common flow path 32 is coupled to the pressurization pump 31. The downstream end of the common flow path 32 and the upstream end of the distribution flow path 34 are coupled to the distributor 33. The distributor 33 distributes the pressurized fluid that has flowed in through the common flow path 32 to the distribution flow paths 34. The distribution flow paths 34 are provided so as to correspond to the respective cartridges 13 and the downstream ends of the distribution flow paths 34 are coupled to the corresponding cartridges 13. One of the distribution flow paths 34 is a flow path which branches into a first branch flow path 36*a*, a second branch flow path 36*b*, and a third branch flow path 36*c* at a valve 35 provided on the flow path to the cartridge 13.

The liquid ejecting apparatus 12 has a control unit 38 comprehensively controlling the liquid ejecting apparatus 12. The control unit 38 is constituted by, for example, a processing circuit including a memory and a computer and controls, for example, the driving of the pressurization mechanism and ink ejection from the liquid ejecting head 25 in accordance with a program stored in the memory. The control unit 38 calculates the amount of remaining ink based on the amount of ink ejected from the liquid ejecting head 25. The control unit 38 writes the calculated amount of remaining ink into the storage device of the cartridge 13. The control unit 38 controls the supply of the pressurized fluid to the cartridge 13 by controlling the operation of the pressurization mechanism 29 such as the driving of the pressurization pump 31 and the opening/closing of the valve 35. An ink accommodating body accommodating ink is pressed in the cartridge 13 supplied with the pressurized fluid. As a result, the ink accommodated in the ink accommodating body is supplied to the valve unit 26 through the ink flow path 30.

To the cartridge 13 to which the first branch flow path 36*a*, the second branch flow path 36*b*, and the third branch flow path 36*c* are coupled, a pressurized fluid for ink supply for supplying ink to the liquid ejecting head 25 is supplied through the first branch flow path 36*a*. A pressurized fluid for ink stirring for stirring the ink accommodated in a liquid accommodating body is supplied through the second branch flow path 36*b* and the third branch flow path 36*c*.

Figure 2:
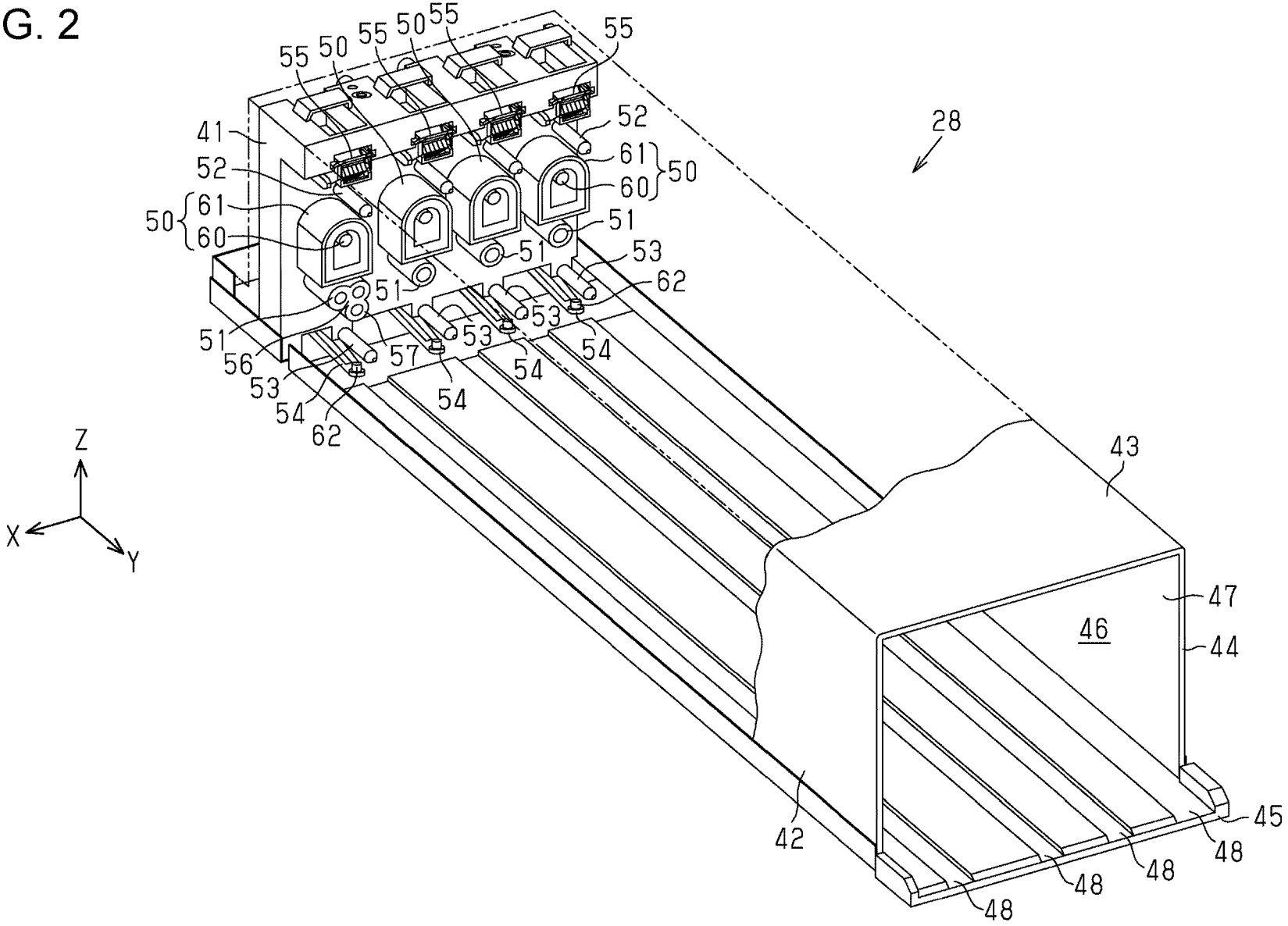
FIG. 2 is a perspective view illustrating a partial configuration of a cartridge mounting portion in the first embodiment.

FIG. 2 is a perspective view illustrating the cartridge mounting portion 28 as an example. In FIG. 2, a part of the configuration is omitted such that the internal configuration of the cartridge mounting portion 28 can be visually recognized. The direction of movement of the cartridge 13 when the cartridge 13 is mounted into the cartridge mounting portion 28 will be referred to as the mounting direction. The mounting direction is the −Y direction. The direction of movement of the cartridge 13 when the cartridge 13 is removed from the cartridge mounting portion 28 will be referred to as the removal direction. The removal direction is the +Y direction.

As illustrated in FIG. 2, the cartridge mounting portion 28 has an apparatus side front wall portion 41 and apparatus side side wall portions 42, 43, 44, and 45 and has a substantially rectangular parallelepiped shape that is long in the Y direction. The cartridge mounting portion 28 has a cartridge accommodating chamber 46 formed by the wall portions 41 to 45. The apparatus side front wall portion 41 is a wall portion extending in a plane direction including the X direction and the Z direction in the state of use of the liquid ejecting apparatus 12. The apparatus side side wall portions 42 to 45 are wall portions extending in the +Y direction from the peripheral edge of the apparatus side front wall portion 41. The cartridge mounting portion 28 has a mounting port 47, which is an opening formed by the apparatus side side wall portions 42 to 45 in the +Y direction relative to the apparatus side front wall portion 41 and is an inlet of the cartridge 13 accommodated in the cartridge accommodating chamber 46. The part that accommodates one cartridge 13 in the cartridge mounting portion 28 will be referred to as a slot. The cartridge mounting portion 28 of the present embodiment has four slots 48.

The cartridge mounting portion 28 has an ink introduction mechanism 50, an ink pressurization unit 51, a first apparatus side positioning portion 52, a second apparatus side positioning portion 53, an apparatus side regulation unit 54, and an apparatus side terminal portion 55. The ink pressurization unit 51, the first apparatus side positioning portion 52, the second apparatus side positioning portion 53, the apparatus side regulation unit 54, and the apparatus side terminal portion 55 are supported by the apparatus side front wall portion 41. The ink pressurization unit 51, the first apparatus side positioning portion 52, the second apparatus side positioning portion 53, the apparatus side regulation unit 54, and the apparatus side terminal portion 55 are provided for each slot 48 so as to correspond to the respective cartridges 13. In addition, the cartridge mounting portion 28 is provided with a first stirring pressurization unit 56 and a second stirring pressurization unit 57 in one of the slots 48. The first stirring pressurization unit and the second stirring pressurization unit 57 are supported by the apparatus side front wall portion 41.

The ink introduction mechanism 50 becomes capable of introducing the ink in the cartridge 13 into the liquid ejecting apparatus 12 when the cartridge 13 is coupled thereto. The ink introduction mechanism 50 is positioned at the middle portion in the Z-direction of the apparatus side front wall portion 41. The ink introduction mechanism 50 is provided with an ink introduction portion 60 and a cover portion 61. The ink introduction portion 60 is a tubular member extending in the Y direction. The ink introduction portion 60 is coupled to the cartridge 13 by the cartridge 13 being mounted in the cartridge mounting portion 28.

The cover portion 61 surrounds the ink introduction portion 60. The cover portion 61 suppresses ink scattering to the periphery when the cartridge 13 is mounted and removed. The cover portion 61 is configured to be movable in the Y direction and is biased in the +Y direction by a biasing member (not illustrated) constituting the ink introduction mechanism 50. The cover portion 61 moves in the −Y direction relative to the ink introduction portion 60 against the biasing force of the biasing member by the cartridge 13 coming into contact with the cover portion 61 when the cartridge 13 is mounted into the cartridge mounting portion 28. As a result, the tip of the ink introduction portion 60 in the +Y direction protrudes in the +Y direction beyond the cover portion 61. By this protruding part entering the cartridge 13, the ink introduction mechanism 50 becomes capable of introducing the ink in the cartridge 13 into the liquid ejecting apparatus 12.

Figure 7:
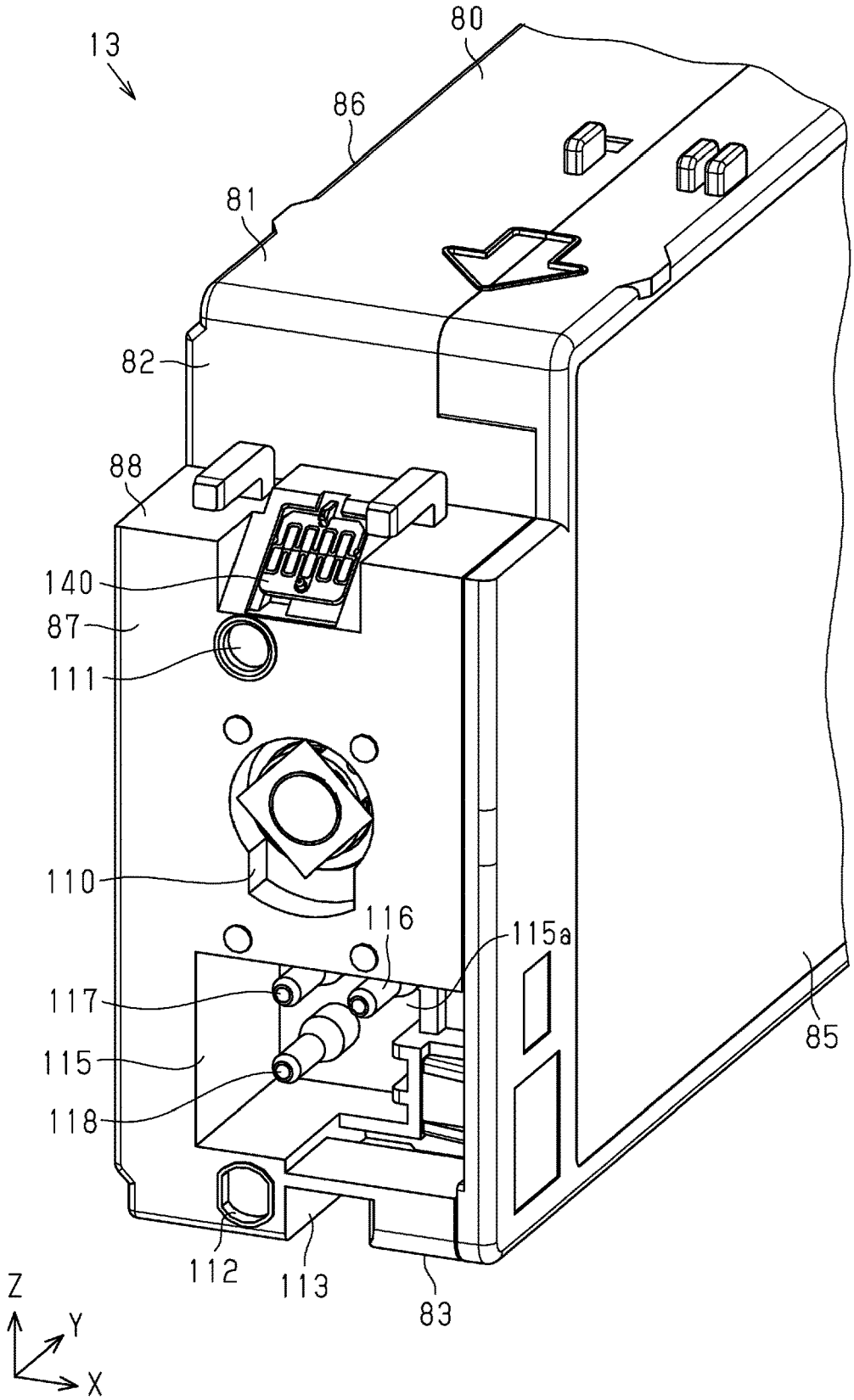
FIG. 7 is a perspective view illustrating a front wall side of the cartridge in the first embodiment.

The ink pressurization unit 51 supplies a pressurized fluid for ink pressurization to the cartridge 13. The ink pressurization unit 51 is positioned in the −Z direction relative to the cover portion 61. The ink pressurization unit 51 is a tubular member extending in the +Y direction. An annular seal member made of rubber or the like is disposed on the inner peripheral surface of the ink pressurization unit 51. The ink pressurization unit 51 is airtightly coupled to the cartridge 13 by a fluid flow portion 116 for ink being inserted. The fluid flow portion 116 for ink is formed in each cartridge 13 and is illustrated in FIG. 7.

Figure 3:
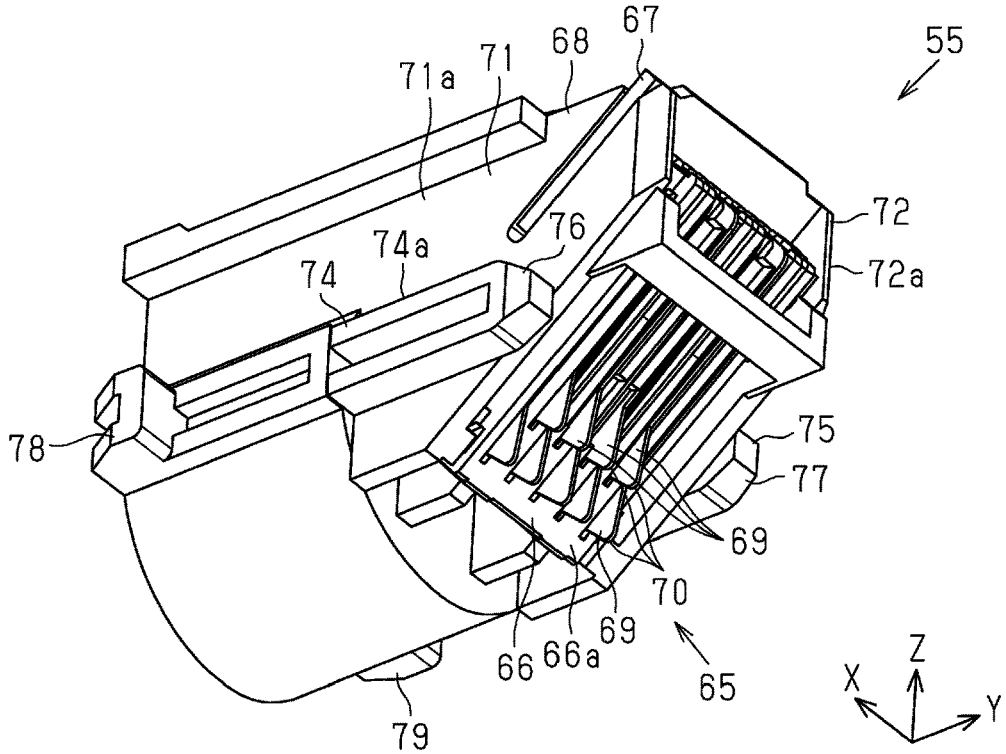
FIG. 3 is a perspective view illustrating an apparatus side terminal portion in the first embodiment.

The first apparatus side positioning portion 52 is positioned in the +Z direction relative to the cover portion 61. The first apparatus side positioning portion 52 has a columnar shape protruding in the +Y direction from the apparatus side front wall portion 41. The first apparatus side positioning portion 52 has a tip positioned further in the +Y direction than the ink pressurization unit 51, the first stirring pressurization unit 56, the second stirring pressurization unit 57, and the ink introduction portion 60. In addition, the tip of the first apparatus side positioning portion 52 is positioned further in the +Y direction than an apparatus side terminal group 65, which is formed in the apparatus side terminal portion 55 and is illustrated in FIG. 3.

The second apparatus side positioning portion 53 is positioned in the −Z direction relative to the cover portion 61 and the ink pressurization unit 51. The second apparatus side positioning portion 53 has a columnar shape protruding in the +Y direction from the apparatus side front wall portion 41. As in the case of the first apparatus side positioning portion 52, the second apparatus side positioning portion 53 has a tip positioned further in the +Y direction than the ink pressurization unit 51, the first stirring pressurization unit 56, the second stirring pressurization unit 57, and the ink introduction portion 60. In addition, the tip of the second apparatus side positioning portion 53 is positioned further in the +Y direction than the apparatus side terminal group 65, which is formed in the apparatus side terminal portion 55 and is illustrated in FIG. 3.

The first apparatus side positioning portion 52 and the second apparatus side positioning portion 53 position the cartridge 13 in a mounting process in which the cartridge 13 is mounted into the cartridge mounting portion 28. Specifically, the first apparatus side positioning portion 52 and the second apparatus side positioning portion 53 position the cartridge 13 in a direction intersecting with the −Y direction, which is the mounting direction of the cartridge 13. The first apparatus side positioning portion 52 and the second apparatus side positioning portion 53 align the cartridge 13 relative to the ink introduction portion 60, the ink pressurization unit 51, the first stirring pressurization unit 56, and the second stirring pressurization unit 57.

The apparatus side regulation unit 54 regulates the displacement of the cartridge 13 in a mounting state where the cartridge 13 is mounted in the cartridge mounting portion 28. The apparatus side regulation unit 54 has a pin 62, which extends in the +Z direction, in the tip portion of the part of the apparatus side regulation unit 54 that extends in the +Y direction from the apparatus side front wall portion 41. The pin 62 of the apparatus side regulation unit 54 is engaged with the cartridge 13. The cartridge 13 in the mounting state receives a pressing force in the +Y direction based on the biasing member biasing the cover portion 61. The apparatus side regulation unit 54 regulates the displacement of the cartridge 13 in the +Y direction that is attributable to the pressing force.

The pressurized fluid that stirs the ink in the cartridge 13 in the mounting state flows through the first stirring pressurization unit 56. The first stirring pressurization unit 56 has a tubular shape extending in the +Y direction from the apparatus side front wall portion 41. The pressurized fluid is supplied from the second branch flow path 36*b* to the first stirring pressurization unit 56. An annular seal member made of rubber or the like is disposed on the inner peripheral surface of the first stirring pressurization unit 56. The first stirring pressurization unit 56 is coupled to the cartridge 13 by a first stirring fluid flow portion 117 being inserted. The first stirring fluid flow portion 117 is formed in the cartridge 13 and is illustrated in FIG. 7.

The pressurized fluid that stirs the liquid accommodating body of the cartridge 13 flows through the second stirring pressurization unit 57. The second stirring pressurization unit 57 has a tubular shape extending in the +Y direction from the apparatus side front wall portion 41. The pressurized fluid is supplied from the third branch flow path 36*c* to the second stirring pressurization unit 57. An annular seal member made of rubber or the like is disposed on the inner peripheral surface of the second stirring pressurization unit 57. The second stirring pressurization unit 57 is airtightly coupled to the cartridge 13 by a second stirring fluid flow portion 118 being inserted. The second stirring fluid flow portion 118 is formed in the cartridge 13.

As illustrated in FIG. 2, the apparatus side terminal portion 55 is positioned in the +Z direction relative to the first apparatus side positioning portion 52 in the apparatus side front wall portion 41.

Figure 4:
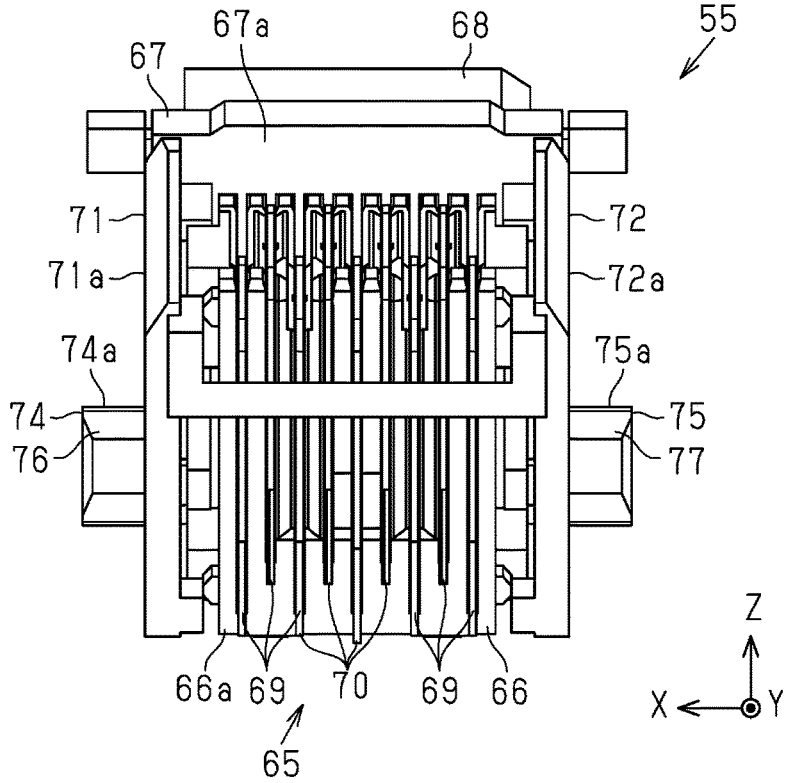
FIG. 4 is a front view illustrating a partial configuration of the apparatus side terminal portion in the first embodiment.

As illustrated in FIGS. 3 and 4, the apparatus side terminal portion 55 is provided with the apparatus side terminal group 65, a terminal block 66, a connector substrate 67, and a holder 68. The apparatus side terminal group 65 is supported by the terminal block 66. The terminal block 66 and the connector substrate 67 are held by the holder 68.

Figure 9:
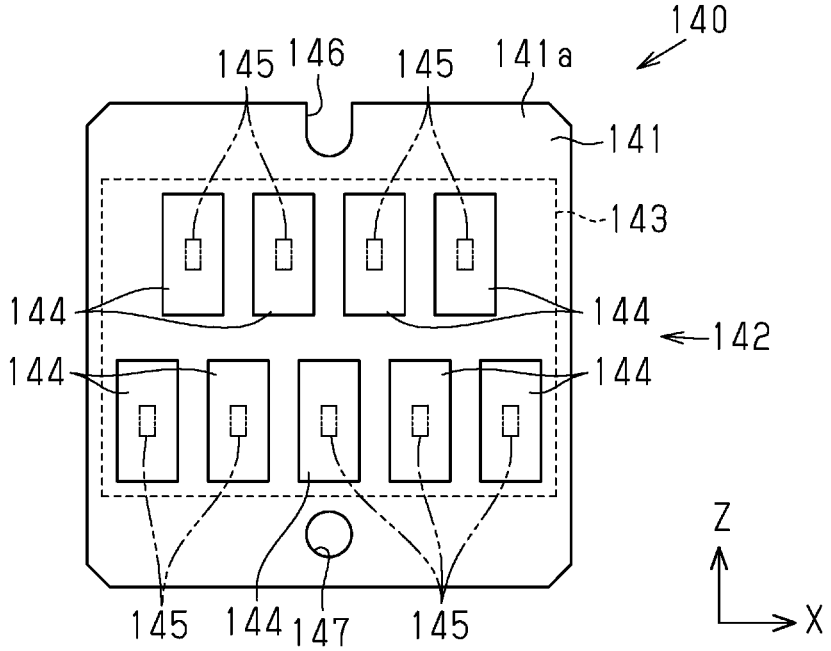
FIG. 9 is a plan view schematically illustrating a circuit substrate in the first embodiment.

A plurality of (nine in the present example) apparatus side terminals 69 constitute the apparatus side terminal group 65. Each apparatus side terminal 69 is configured to be elastically deformable by a leaf spring having a pair of arm portions facing each other. One of the arm portions in each apparatus side terminal 69 has a tip provided with a terminal contact point 70 protruding from a terminal block surface 66*a* of the terminal block 66. The terminal contact point 70 is pressed by a cartridge side terminal 144 of the cartridge 13, which is illustrated in FIG. 9, when the cartridge 13 is mounted. As a result, the arm portion is elastically deformed in the direction in which the terminal contact point 70 enters the terminal block 66 from the terminal block surface 66*a*. In other words, the terminal contact point 70 is in contact with the cartridge side terminal 144 on the terminal block surface 66*a* in the mounting state.

The other arm portion in each apparatus side terminal 69 has a terminal contact point (not illustrated) protruding from the terminal block back surface on the side that is opposite to the terminal block surface 66*a* of the terminal block 66. This terminal contact point is pressed against the terminal (not illustrated) that is formed on a connector surface 67*a* of the connector substrate 67. As a result, this arm portion is elastically deformed in the direction in which the terminal contact point enters the terminal block 66 from the terminal block back surface. In other words, the terminal contact point of this arm portion is in contact with the terminal (not illustrated) that is formed on the connector surface 67*a* of the connector substrate 67 on the terminal block back surface.

The connector substrate 67 is electrically coupled to the control unit 38 of the liquid ejecting apparatus 12 via wiring (not illustrated). In other words, the apparatus side terminal 69 is electrically coupled to the control unit 38 of the liquid ejecting apparatus 12.

The holder 68 holds the terminal block 66 and the connector substrate 67 in a state where the terminal contact point formed in the other arm portion in each apparatus side terminal 69 is pressed against the connector substrate 67. The holder 68 has a first holder side wall portion 71 and a second holder side wall portion 72. The first holder side wall portion 71 has a first outside surface 71*a*, which is a surface including the Y direction and the Z direction and is positioned in the +X direction in the holder 68. The second holder side wall portion 72 has a second outside surface 72*a*, which is a surface including the Y direction and the Z direction and is positioned in the −X direction in the holder 68.

The holder 68 holds the terminal block 66 and the connector substrate 67 between the first holder side wall portion 71 and the second holder side wall portion 72. The holder 68 holds the terminal block 66 and the connector substrate 67 in an inclined state. The holder 68 holds the terminal block 66 and the connector substrate 67 such that the terminal block surface 66*a* of the terminal block 66 and the connector surface 67*a* of the connector substrate 67 face the direction that includes a component in the +Y direction and a component in the −Z direction. In other words, the holder 68 holds the terminal block 66 and the connector substrate 67 such that the perpendicular direction of the terminal block surface 66*a* and the connector surface 67*a* includes a component in the +Y direction and a component in the −Z direction.

The holder 68 has a first projection-shaped portion 74 on the first outside surface 71*a* and a second projection-shaped portion 75 on the second outside surface 72*a*. The first projection-shaped portion 74 is integrally coupled to the first outside surface 71*a*. The first projection-shaped portion 74 extends in the −Y direction from a position that is further in the +Z direction than the terminal contact point 70. A first tapered portion 76, which is the end portion of the first projection-shaped portion 74 in the +Y direction, is positioned further in the +Y direction than the terminal contact point 70. The first tapered portion 76 is formed in a shape in which corner portions in the +Z direction and the −Z direction are notched. The first projection-shaped portion 74 has a first upper side surface 74*a*, which is a surface including the X direction and the Y direction and is positioned in the +X direction in the holder 68.

The second projection-shaped portion 75 is integrally coupled to the surface of the second holder side wall portion 72 in the −X direction. The second projection-shaped portion 75 extends in the −Y direction from a position that is further in the +Z direction than the terminal contact point 70. The second projection-shaped portion 75 is disposed such that a second tapered portion 77, which is an end portion in the +Y direction, is positioned further in the +Y direction than the terminal contact point 70. The second tapered portion 77 is formed in a tapered shape in which the Z-direction dimension value of the second tapered portion 77 decreases in the +Y direction such that corner portions in the +Z direction and the −Z direction are notched. The second projection-shaped portion 75 has a second upper side surface 75*a*, which is a surface including the X direction and the Y direction and is positioned in the −X direction in the holder 68.

The holder 68 has a first engagement portion 78 on the first outside surface 71*a* and a second engagement portion 79 on the second outside surface 72*a*. The first engagement portion 78 and the second engagement portion 79 are not illustrated in FIG. 4. The holder 68 is attached to the apparatus side front wall portion 41 by the first engagement portion 78 and the second engagement portion 79 being engaged with a pair of engagement holes (not illustrated) formed in the apparatus side front wall portion 41. The holder 68 is attached to the apparatus side front wall portion 41 in a state where the holder 68 holds the terminal block 66 and the connector substrate 67.

In the holder 68 configured as described above, the first outside surface 71*a* and the first upper side surface 74*a* constitute a first apparatus side contact portion provided in the +X direction in the holder 68. The second outside surface 72*a* and the second upper side surface 75*a* constitute a second apparatus side contact portion provided in the −X direction in the holder 68.

Figure 5:
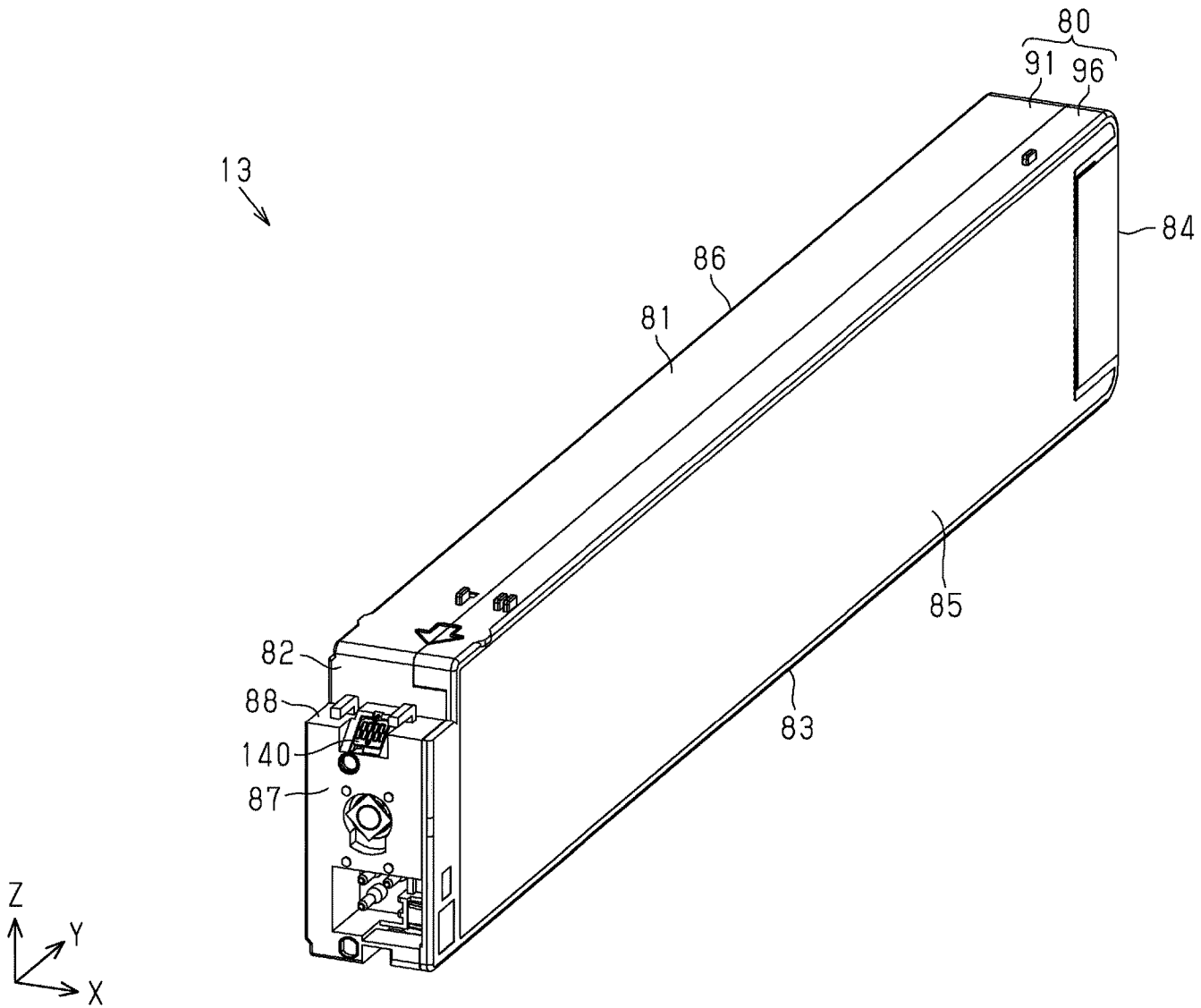
FIG. 5 is a perspective view illustrating a cartridge in the first embodiment.

As illustrated in FIG. 5, the cartridge 13 is provided with a case 80. The case 80 has a substantially rectangular parallelepiped shape increasing in dimension value in the order of the X direction, the Z direction, and the Y direction. The case 80 has a first wall 81, a second wall 82, a third wall 83, a fourth wall 84, a fifth wall 85, and a sixth wall 86. The first wall 81 and the third wall 83 include the X direction and the Y direction. The first wall 81 is positioned in the +Z direction and the third wall 83 is positioned in the −Z direction. The second wall 82 and the fourth wall 84 include the X direction and the Z direction. The second wall 82 is positioned in the −Y direction and the fourth wall 84 is positioned in the +Y direction. The fifth wall 85 and the sixth wall 86 include the Y direction and the Z direction. The fifth wall 85 is positioned in the +X direction and the sixth wall 86 is positioned in the −X direction.

The case 80 has a front wall 87 and a terminal disposition wall portion 88 in addition to the first wall 81 to the sixth wall 86 described above. The front wall 87 includes the X direction and the Z direction. The front wall 87 is positioned further in the −Y direction than the second wall 82. The front wall 87 is coupled to each of the −Y-direction end portions of the third wall 83, the fifth wall 85, and the sixth wall 86. The terminal disposition wall portion 88 couples the second wall 82 and the +Z-direction end portion of the front wall 87. The terminal disposition wall portion 88 is positioned further in the −X direction than the first wall 81. A circuit substrate 140 is disposed in the terminal disposition wall portion 88.

Figure 6:
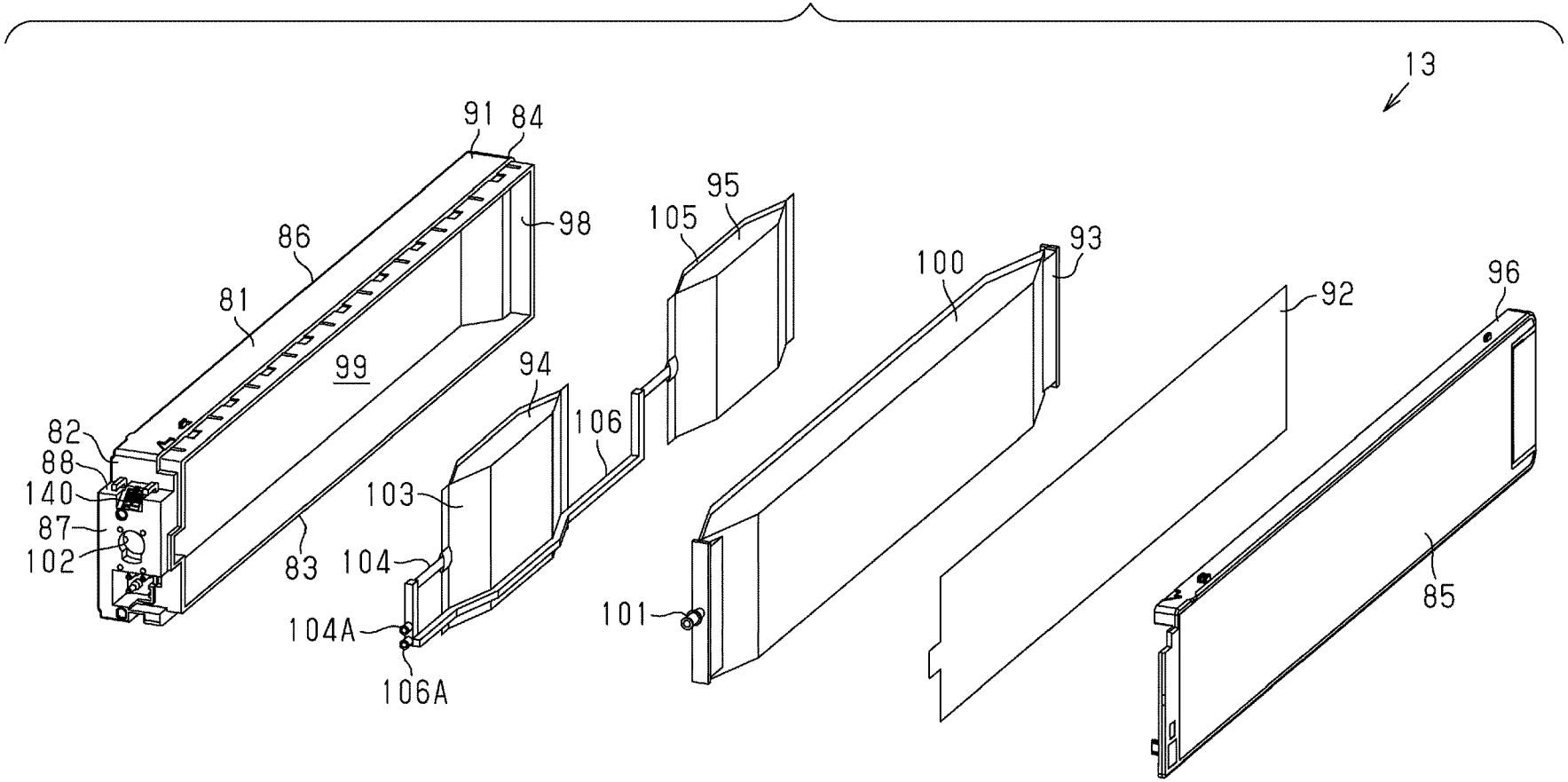
FIG. 6 is an exploded perspective view illustrating the cartridge in the first embodiment.

As illustrated in FIG. 6, the cartridge 13 is provided with a first case member 91, a sealing member 92, an ink accommodating portion 93, a first stirring portion 94, a second stirring portion 95, and a second case member 96. The first case member 91 and the second case member 96 constitute the case 80. The first case member 91 and the second case member 96 may be manufactured by a synthetic resin such as polypropylene and polystyrene being molded.

The first case member 91 is formed in a recessed shape having an opening 98 in the +X direction. The first case member 91 mainly forms the first wall 81, the second wall 82, the third wall 83, the fourth wall 84, the sixth wall 86, the front wall 87, and the terminal disposition wall portion 88. The internal space of the first case member 91 constitutes a pressurization chamber 99.

The sealing member 92 seals the opening 98 of the first case member 91. The sealing member 92 is joined to the first case member 91 by a joining method such as welding and adhesion. The sealing member 92 is joined in a state where the first stirring portion 94, the second stirring portion 95, and the ink accommodating portion 93 are stored in the first case member 91.

The ink accommodating portion 93 is stored in the pressurization chamber 99. The ink accommodating portion 93 is provided with an ink accommodating body 100 and an ink outlet portion 101. The ink accommodating body 100 accommodates ink. At least a part of the ink accommodating body 100 is formed in a bag body by a flexible member. The volume of the ink accommodating body 100 decreases as the ink is consumed. The ink outlet portion 101 guides out the ink accommodated in the ink accommodating body 100 to the liquid ejecting apparatus 12. The ink outlet portion 101 is coupled to the −Y direction end portion of the ink accommodating body 100. The ink outlet portion 101 is a tubular member extending in the −Y direction from the part of coupling to the ink accommodating body 100. The −Y direction end portion of the ink outlet portion 101 is disposed outside the pressurization chamber 99 through an outlet opening 102 formed in the first case member 91. A valve mechanism is disposed in the ink outlet portion 101. The valve mechanism is opened by the ink introduction portion 60 of the cartridge mounting portion 28 being inserted in the mounting process in which the cartridge 13 is mounted. As a result, the ink outlet portion 101 and the ink introduction portion 60 are coupled. The ink accommodating portion 93 is configured to seal the outlet opening 102. The ink accommodating body 100 is pressed by a pressurized fluid being supplied to the pressurization chamber 99. Then, the ink in the ink accommodating body 100 is pressurized. As a result, the ink flows out from the ink accommodating body 100 through the ink outlet portion 101.

The first stirring portion 94 and the second stirring portion 95 are stored in the pressurization chamber 99. The first stirring portion 94 and the second stirring portion 95 are positioned in a region that is further in the −X direction than the ink accommodating body 100 so as to be adjacent to the ink accommodating body 100 in the X direction.

The first stirring portion 94 has a first stirring member 103 and a first fluid flow passage 104. The first stirring member 103 is a flexible bag body. The first stirring member 103 is positioned in the region of the pressurization chamber 99 that is on the −Y-direction side. One end of the first fluid flow passage 104 is coupled to the first stirring member 103. The other end 104A of the first fluid flow passage 104 is coupled to the first stirring fluid flow portion 117 illustrated in FIG. 7. The first stirring fluid flow portion 117 is a part to which the first stirring pressurization unit 56 is coupled in the mounting state of the cartridge 13. The first stirring member 103 expands when the pressurized fluid pressurized by the pressurization pump 31 is supplied and contracts when the supply of the pressurized fluid by the pressurization pump 31 is stopped. In other words, the first stirring portion 94 stirs the ink accommodated in the ink accommodating body 100 by the first stirring member 103 expanding and contracting as a result of the flow of the pressurized fluid through the first fluid flow passage 104.

The second stirring portion 95 has a second stirring member 105 and a second fluid flow passage 106. The second stirring member 105 is a flexible bag body. The second stirring member 105 is positioned in the region of the pressurization chamber 99 that is on the +Y-direction side. One end of the second fluid flow passage 106 is coupled to the second stirring member 105. The other end 106A of the second fluid flow passage 106 is coupled to the second stirring fluid flow portion 118 illustrated in FIG. 7 in the mounting state of the cartridge 13. The second stirring fluid flow portion 118 is a part to which the second stirring pressurization unit 57 is coupled. The second stirring member 105 expands when the pressurized fluid pressurized by the pressurization pump 31 is supplied and contracts when the supply of the pressurized fluid by the pressurization pump 31 is stopped. In other words, the second stirring portion 95 stirs the ink accommodated in the ink accommodating body 100 by the second stirring member 105 expanding and contracting as a result of the flow of the pressurized fluid through the second fluid flow passage 106.

The first stirring portion 94 and the second stirring portion 95 are alternately supplied with a pressurized fluid. In other words, pressurized fluid supply to the second stirring portion 95 is stopped when a pressurized fluid is supplied to the first stirring portion 94. In addition, pressurized fluid supply to the first stirring portion 94 is stopped when a pressurized fluid is supplied to the second stirring portion 95. As a result of such ink stirring, the pigment particles settled in the ink accommodating body 100 flow and variations in the concentration distribution of the pigment particles in the ink in the ink accommodating body 100 are reduced.

The second case member 96 is attached to the first case member 91 so as to cover the sealing member 92. The second case member 96 mainly forms the fifth wall 85. The first case member 91 and the second case member 96 protect the first stirring portion 94, the second stirring portion 95, the ink accommodating body 100, and the sealing member 92.

As illustrated in FIG. 7, the cartridge 13 has an outlet space forming portion 110, a first cartridge side positioning portion 111, a second cartridge side positioning portion 112, and a cartridge side regulation unit 113.

The outlet space forming portion 110 forms the space where the ink outlet portion 101 of the ink accommodating portion 93 is disposed. The outlet space forming portion 110 forms an opening in the middle part of the front wall 87 in the Z direction and the X direction. The outlet space forming portion 110 extends in the +Y direction from the front wall 87 and has the outlet opening 102 in the +Y-direction end portion of the outlet space forming portion 110.

The first cartridge side positioning portion 111 is positioned in the +Z direction relative to the outlet space forming portion 110. The first cartridge side positioning portion 111 extends in the +Y direction from the opening formed in the front wall 87. The first cartridge side positioning portion 111 has a circular sectional shape. The first apparatus side positioning portion 52 of the cartridge mounting portion 28 is inserted into the first cartridge side positioning portion 111 in the mounting process in which the cartridge 13 is mounted.

The second cartridge side positioning portion 112 is positioned in the −Z direction relative to the outlet space forming portion 110. The second cartridge side positioning portion 112 extends in the +Y direction from the opening formed in the front wall 87. The second cartridge side positioning portion 112 has an elliptical sectional shape having a longitudinal direction set in the Z direction. The second apparatus side positioning portion 53 of the cartridge mounting portion 28 is inserted into the second cartridge side positioning portion 112 in the mounting process in which the cartridge 13 is mounted.

In the mounting process in which the cartridge 13 is mounted, the cartridge 13 moves in the −Y direction, which is the mounting direction, and soon the tips of the first and second apparatus side positioning portions 52 and 53 are inserted into the first and second cartridge side positioning portions 111 and 112. Subsequently, the displacement of the cartridge 13 in the direction intersecting with the mounting direction is limited and the cartridge 13 moves in the mounting direction with reference to the first and second apparatus side positioning portions 52 and 53. At this time, it is possible to easily allow a manufacturing error or the like occurring in the cartridge mounting portion 28 or the cartridge 13 while limiting the displacement of the cartridge 13 in the direction intersecting with the mounting direction since the second cartridge side positioning portion 112 has an elliptical sectional shape. In the mounting process in which the cartridge 13 is mounted, alignment of the ink outlet portion 101 and the ink introduction portion 60 is performed by positioning by means of the first apparatus side positioning portion 52, the second apparatus side positioning portion 53, the first cartridge side positioning portion 111, and the second cartridge side positioning portion 112.

The cartridge side regulation unit 113 is positioned further in the −Z direction than the second cartridge side positioning portion 112. The cartridge side regulation unit 113 is a groove portion formed in the third wall 83 and has an opening in the front wall 87. The cartridge side regulation unit 113 is engaged with the pin 62 of the apparatus side regulation unit 54. The pin 62 of the apparatus side regulation unit 54 moves in the cartridge side regulation unit 113 in the mounting process in which the cartridge 13 is mounted. In the mounting state of the cartridge 13, the pin 62 regulates displacement of the cartridge 13 by being engaged with the cartridge side regulation unit 113. The engagement between the pin 62 and the cartridge side regulation unit 113 is released by the cartridge 13 in the mounting state being pushed in the −Y direction, and then the cartridge 13 can be removed from the cartridge mounting portion 28. While the cartridge 13 is removed from the cartridge mounting portion 28, the pin 62 of the apparatus side regulation unit 54 moves in the cartridge side regulation unit 113 and withdraws from the cartridge side regulation unit 113 soon.

As illustrated in FIG. 7, the cartridge 13 has a recessed portion 115, the fluid flow portion 116 for ink, the first stirring fluid flow portion 117, and the second stirring fluid flow portion 118.

The recessed portion 115 is formed in the −Z direction relative to the outlet space forming portion 110 and in the +Z direction relative to the second cartridge side positioning portion 112. The recessed portion 115 is a substantially rectangular recessed portion extending in the +Y direction from the opening formed in the front wall 87.

The pressurized fluid for ink pressurization that is supplied to the pressurization chamber 99 flows through the fluid flow portion 116 for ink. The fluid flow portion 116 for ink has a tubular shape extending in the −Y direction from a bottom wall 115*a* of the recessed portion 115 in the internal space of the recessed portion 115. The fluid flow portion 116 for ink allows the pressurization chamber 99 to communicate with the outside of the cartridge 13. The fluid flow portion 116 for ink is airtightly coupled to the ink pressurization unit 51 by being inserted into the annular seal member of the ink pressurization unit 51. In the mounting process in which the cartridge 13 is mounted, alignment of the fluid flow portion 116 for ink and the ink pressurization unit 51 is performed by positioning by means of the first apparatus side positioning portion 52, the second apparatus side positioning portion 53, the first cartridge side positioning portion 111, and the second cartridge side positioning portion 112.

The pressurized fluid that is used for ink stirring by the first stirring portion 94 flows through the first stirring fluid flow portion 117. The first stirring fluid flow portion 117 has a tubular shape extending in the −Y direction from the bottom wall 115*a* of the recessed portion 115 in the internal space of the recessed portion 115. The first stirring fluid flow portion 117 allows the first fluid flow passage 104 to communicate with the outside of the cartridge 13. The first stirring fluid flow portion 117 is airtightly coupled to the first stirring pressurization unit 56 by being inserted into the annular seal member of the first stirring pressurization unit 56. The first stirring fluid flow portion 117 introduces the pressurized fluid that is supplied through the first stirring pressurization unit 56 by the pressurization pump 31 being driven into the first fluid flow passage 104. The first stirring fluid flow portion 117 allows the pressurized fluid that is discharged from the first stirring member 103 by the pressurization pump 31 being stopped to flow out from the first fluid flow passage 104. In the mounting process in which the cartridge 13 is mounted, alignment of the first stirring fluid flow portion 117 and the first stirring pressurization unit 56 is performed by positioning by means of the first apparatus side positioning portion 52, the second apparatus side positioning portion 53, the first cartridge side positioning portion 111, and the second cartridge side positioning portion 112.

The pressurized fluid that is used for ink stirring by the second stirring portion 95 flows through the second stirring fluid flow portion 118. The second stirring fluid flow portion 118 has a tubular shape extending in the −Y direction from the bottom wall 115*a* of the recessed portion 115 in the internal space of the recessed portion 115. The second stirring fluid flow portion 118 allows the second fluid flow passage 106 to communicate with the outside of the cartridge 13. The second stirring fluid flow portion 118 is airtightly coupled to the second stirring pressurization unit 57 by being inserted into the annular seal member of the second stirring pressurization unit 57. The second stirring fluid flow portion 118 introduces the pressurized fluid that is supplied through the second stirring pressurization unit 57 by the pressurization pump 31 being driven into the second fluid flow passage 106. The second stirring fluid flow portion 118 allows the pressurized fluid that is discharged from the second stirring member 105 by the pressurization pump 31 being stopped to flow out from the second fluid flow passage 106. In the mounting process in which the cartridge 13 is mounted, alignment of the second stirring fluid flow portion 118 and the second stirring pressurization unit 57 is performed by positioning by means of the first apparatus side positioning portion 52, the second apparatus side positioning portion 53, the first cartridge side positioning portion 111, and the second cartridge side positioning portion 112.

As illustrated in FIG. 7, the terminal disposition wall portion 88 couples the second wall 82 and the +Z-direction end portion of the front wall 87. The terminal disposition wall portion 88 is positioned in the −Z direction relative to the first wall 81. The circuit substrate 140 is disposed in the terminal disposition wall portion 88.

Figure 8:
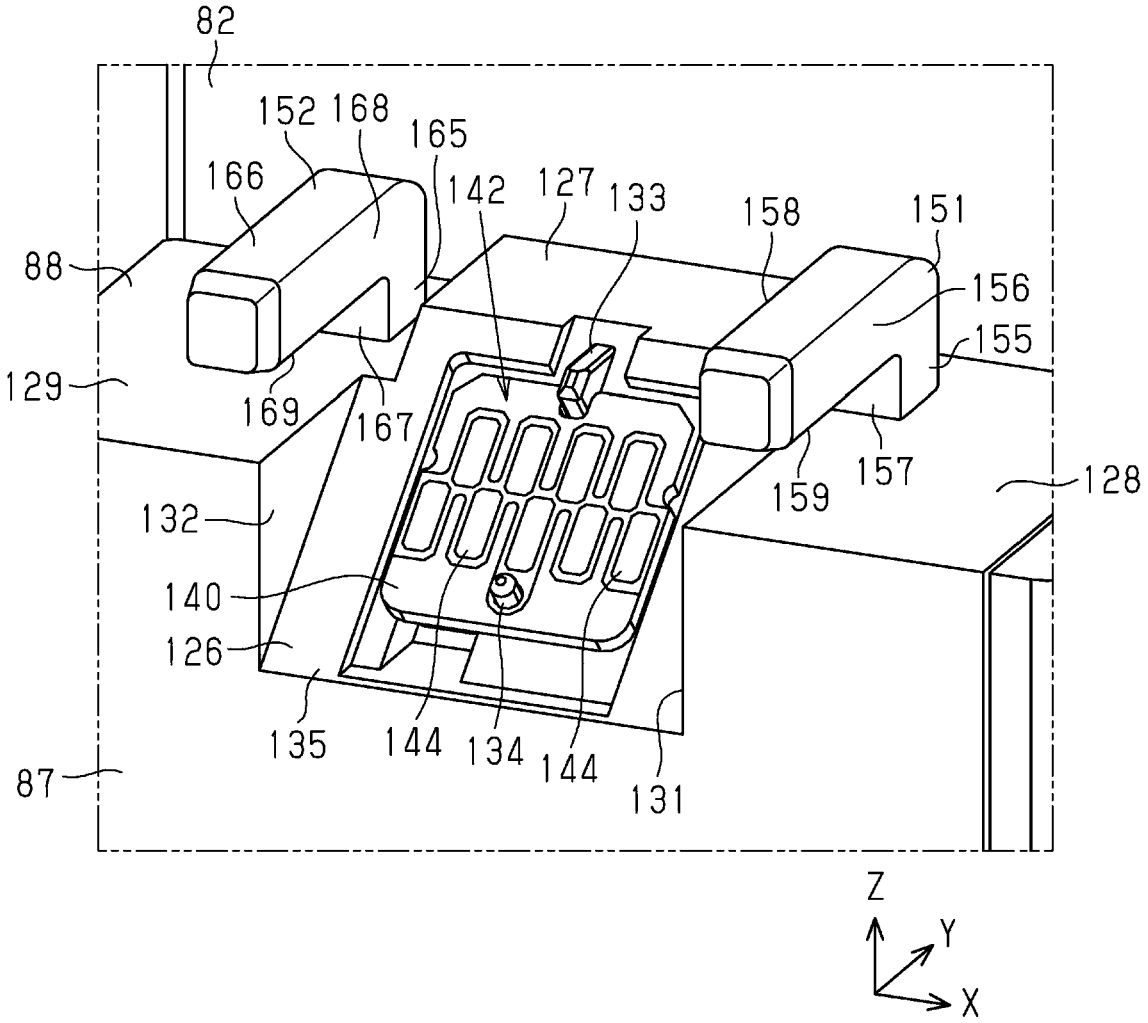
FIG. 8 is a perspective view illustrating a terminal disposition wall portion in the first embodiment.

As illustrated in FIG. 8, the terminal disposition wall portion 88 has an inclined wall 126, a coupling wall 127, a first upper wall 128, a second upper wall 129, a first inside wall 131, and a second inside wall 132. The circuit substrate 140 is disposed in the inclined wall 126. The inclined wall 126 is formed at the X-direction middle part of the terminal disposition wall portion 88. The inclined wall 126 is inclined relative to the −Y direction, which is the mounting direction. Specifically, the inclined wall 126 is inclined so as to face the direction that includes a component in the −Y direction and a component in the +Z direction. In other words, the inclined wall 126 is inclined such that the perpendicular direction of the inclined wall 126 includes a component in the −Y direction and a component in the +Z direction. The −Z-direction end portion of the inclined wall 126 is coupled to the front wall 87. The inclined wall 126 has a first attachment projection portion 133 and a second attachment projection portion 134, which attach the circuit substrate 140 to the inclined wall 126.

The coupling wall 127 is a wall including the X direction and the Y direction. The coupling wall 127 extends in the +Y direction from the end portion of the inclined wall 126 in the +Z direction. The coupling wall 127 couples the end portion of the inclined wall 126 in the +Z direction to the second wall 82.

The first upper wall 128 and the second upper wall 129 are walls including the X direction and the Y direction. The first upper wall 128 is positioned in the +X direction relative to the inclined wall 126. The first upper wall 128 is positioned in the +Z direction relative to the end portion of the inclined wall 126 in the −Z direction. The first upper wall 128 is positioned further in the −Z direction than the coupling wall 127. The first upper wall 128 is coupled to the second wall 82, the fifth wall 85, and the front wall 87 of the case 80.

The second upper wall 129 is positioned in the −X direction relative to the inclined wall 126. The second upper wall 129 is positioned in the +Z direction relative to the end portion of the inclined wall 126 in the −Z direction. The second upper wall 129 is positioned further in the −Z direction than the coupling wall 127. The second upper wall 129 is coupled to the second wall 82, the sixth wall 86, and the front wall 87 of the case 80.

The first inside wall 131 and the second inside wall 132 are walls including the Y direction and the Z direction. The first inside wall 131 and the second inside wall 132 face each other in the X direction. The first inside wall 131 is coupled to the front wall 87, the end portion of the inclined wall 126 in the +X direction, and the end portion of the first upper wall 128 in the −X direction. The second inside wall 132 is coupled to the front wall 87, the end portion of the inclined wall 126 in the −X direction, and the end portion of the second upper wall 129 in the +X direction. The terminal disposition wall portion 88 has a recessed portion 135 for a substrate, which is constituted by the inclined wall 126, the first inside wall 131, and the second inside wall 132.

As illustrated in FIG. 9, the circuit substrate 140 disposed in the inclined wall 126 has a substrate main body 141, a cartridge side terminal group 142, and a storage device 143.

The substrate main body 141 has a substantially rectangular flat plate shape. The cartridge side terminal group 142 is provided on a substrate surface 141*a* of the substrate main body 141. A plurality of the cartridge side terminals 144 constitute the cartridge side terminal group 142. The cartridge side terminal group 142 of the present embodiment is constituted by nine cartridge side terminals 144 so as to correspond to each of the nine apparatus side terminals 69. The cartridge side terminals 144 are arranged so as to correspond respectively to the apparatus side terminals 69 constituting the apparatus side terminal group 65. Each cartridge side terminal 144 has a contact region 145 in the middle portion of the cartridge side terminal 144. The terminal contact point 70 of the corresponding apparatus side terminal 69 is in contact with the contact region 145.

The storage device 143 is provided on the substrate back surface of the substrate main body 141. The storage device 143 stores information related to the ink accommodating body 100. Examples of the information include information related to the amount of remaining ink. The storage device 143 and each cartridge side terminal 144 are electrically coupled to each other.

The circuit substrate 140 has an attachment groove 146 and an attachment hole 147. The attachment groove 146 is formed at the middle part of the end portion of the substrate main body 141 in the +Z direction. The attachment hole 147 is formed at the middle part of the end portion of the substrate main body 141 in the −Z direction. The circuit substrate 140 is attached to the inclined wall 126 by the attachment groove 146 being engaged with the first attachment projection portion 133 formed on the inclined wall 126 and the attachment hole 147 being engaged with the second attachment projection portion 134 formed on the inclined wall 126.

Figure 10:
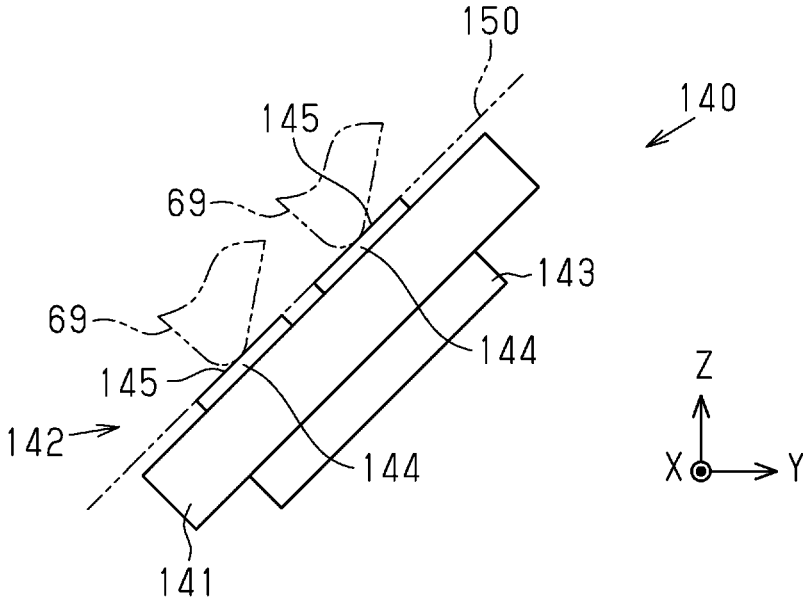
FIG. 10 is a side view schematically illustrating the circuit substrate attached to an inclined wall in the first embodiment.

As illustrated in FIG. 10, a virtual plane 150 defined by the contact region 145 is inclined relative to the −Y direction, which is the mounting direction, when the circuit substrate 140 is attached to the inclined wall 126. Specifically, the virtual plane 150 is inclined so as to face the direction that includes a component in the −Y direction and a component in the +Z direction. In other words, the virtual plane 150 is inclined such that the perpendicular direction of the virtual plane 150 includes a component in the −Y direction and a component in the +Z direction. The contact point between the apparatus side terminal 69 and the cartridge side terminal 144 is positioned on the virtual plane 150. Each cartridge side terminal 144 is electrically coupled to the apparatus side terminal 69 by the apparatus side terminal 69 being in contact with the contact region 145 in the mounting state of the cartridge 13. As a result, the control unit 38 of the liquid ejecting apparatus 12 is capable of accessing the storage device 143.

As illustrated in FIG. 8, the terminal disposition wall portion 88 has a first guiding portion 151 and a second guiding portion 152. The first guiding portion 151 and the second guiding portion 152 are provided so as to face each other in the X direction with the cartridge side terminal group 142 in between when the cartridge side terminal group 142 is viewed from the −Y direction toward the +Y direction. In the mounting process in which the cartridge 13 is mounted, the first guiding portion 151 and the second guiding portion 152 guide the cartridge 13 to a contact position where the apparatus side terminal group 65 and the cartridge side terminal group 142 correctly come into contact with each other.

The first guiding portion 151 is formed on the first upper wall 128. The first guiding portion 151 has a bent arm shape bent in the −Y direction after extending in the +Z direction. The first guiding portion 151 has a first protruding portion 155 and a first extending portion 156. The first protruding portion 155 extends in the +Z direction from the corner portion that is formed by the end portion of the first upper wall 128 in the −X direction and the end portion of the first upper wall 128 in the +Y direction. The first protruding portion 155 has a polygonal sectional shape. In the present embodiment, the first protruding portion 155 has a quadrangular sectional shape. The first extending portion 156 extends in the −Y direction from the end portion of the first protruding portion 155 in the +Z direction. The first extending portion 156 has a polygonal sectional shape. In the present embodiment, the first extending portion 156 has a quadrangular sectional shape. The polygonal shape may be a projecting polygonal shape. A first insertion recessed portion 157 is formed in the terminal disposition wall portion 88 by the first upper wall 128, the first protruding portion 155, and the first extending portion 156. In the mounting process in which the cartridge 13 is mounted, the first projection-shaped portion 74 of the holder 68 illustrated in FIGS. 3 and 4 is inserted into the first insertion recessed portion 157. The first insertion recessed portion 157 is open in the +X direction and the −X direction in addition to the −Y direction.

The first guiding portion 151 has a first inside surface 158 and a first lower side surface 159. The first inside surface 158 and the first lower side surface 159 constitute a first cartridge side contact portion. The first inside surface 158 is a part that is capable of coming into contact with the first holder side wall portion 71 of the holder 68 from the +X direction in the mounting process in which the cartridge 13 is mounted and capable of being in contact with the first holder side wall portion 71 of the holder 68 from the +X direction in the mounting state of the cartridge 13. The first inside surface 158 is a surface including the Y direction and the Z direction. The first inside surface 158 is provided in the −X direction in the first protruding portion 155 and the first extending portion 156 so as to straddle the first protruding portion 155 and the first extending portion 156. The first inside surface 158 comes into surface contact with the first outside surface 71*a* when the first inside surface 158 comes into contact with the first holder side wall portion 71.

The first lower side surface 159 is a part that is capable of coming into contact with the first projection-shaped portion 74 of the holder 68 from the +Z direction in the mounting process in which the cartridge 13 is mounted and capable of being in contact with the first projection-shaped portion 74 of the holder 68 from the +Z direction in the mounting state of the cartridge 13. The first lower side surface 159 is a surface including the X direction and the Y direction. The first lower side surface 159 is provided in the −Z direction in the first extending portion 156. The first lower side surface 159 comes into surface contact with the first upper side surface 74*a* when the first lower side surface 159 comes into contact with the first projection-shaped portion 74.

The second guiding portion 152 is formed on the second upper wall 129. The second guiding portion 152 has a bent arm shape bent in the −Y direction after extending in the +Z direction. The second guiding portion 152 has a second protruding portion 165 and a second extending portion 166. The second protruding portion 165 extends in the +Z direction from the corner portion that is formed by the end portion of the second upper wall 129 in the +X direction and the end portion of the second upper wall 129 in the +Y direction. The second protruding portion 165 has a polygonal sectional shape. In the present embodiment, the second protruding portion 165 has a quadrangular sectional shape. The polygonal shape may be a projecting polygonal shape. The second extending portion 166 extends in the −Y direction from the end portion of the second protruding portion 165 in the +Z direction. The second extending portion 166 has a polygonal sectional shape. In the present embodiment, the second extending portion 166 has a quadrangular sectional shape. A second insertion recessed portion 167 is formed in the terminal disposition wall portion 88 by the second upper wall 129, the second protruding portion 165, and the second extending portion 166. In the mounting process in which the cartridge 13 is mounted, the second projection-shaped portion 75 illustrated in FIGS. 3 and 4 is inserted into the second insertion recessed portion 167 from the −Y direction. The second insertion recessed portion 167 is open in the +X direction and the −X direction in addition to the −Y direction.

The second guiding portion 152 has a second inside surface 168 and a second lower side surface 169. The second inside surface 168 and the second lower side surface 169 constitute a second cartridge side contact portion. The second inside surface 168 is a part that is capable of coming into contact with the second holder side wall portion 72 of the holder 68 of the apparatus side terminal portion 55 from the −X direction in the mounting process in which the cartridge 13 is mounted and capable of being in contact with the second holder side wall portion 72 of the holder 68 of the apparatus side terminal portion 55 from the −X direction in the mounting state of the cartridge 13. The second inside surface 168 is a surface including the Y direction and the Z direction. The second inside surface 168 is provided in the +X direction in the second protruding portion 165 and the second extending portion 166 so as to straddle the second protruding portion 165 and the second extending portion 166. The second inside surface 168 comes into surface contact with the second outside surface 72*a* when the second inside surface 168 comes into contact with the second holder side wall portion 72.

The second lower side surface 169 is a part that is capable of coming into contact with the second projection-shaped portion 75 of the holder 68 from the +Z direction in the mounting process in which the cartridge 13 is mounted and capable of being in contact with the second projection-shaped portion 75 of the holder 68 from the +Z direction in the mounting state of the cartridge 13. The second lower side surface 169 is a surface including the X direction and the Y direction. The second lower side surface 169 is provided in the −Z direction in the second extending portion 166. The second lower side surface 169 comes into surface contact with the second upper side surface 75*a* when the second lower side surface 169 comes into contact with the second projection-shaped portion 75.

In the mounting process, the cartridge 13 moves in the −Y direction while the first inside surface 158, the first lower side surface 159, the second inside surface 168, and the second lower side surface 169 are guided by each portion of the holder 68. As a result, the cartridge 13 is mounted into the cartridge mounting portion 28 at the contact position where the apparatus side terminal group 65 and the cartridge side terminal group 142 correctly come into contact with each other. Guiding related to such terminal contact is initiated after positioning by means of the first cartridge side positioning portion 111 and the second cartridge side positioning portion 112 is initiated.

The action of the cartridge 13 configured as described above will be described.

Figure 11:
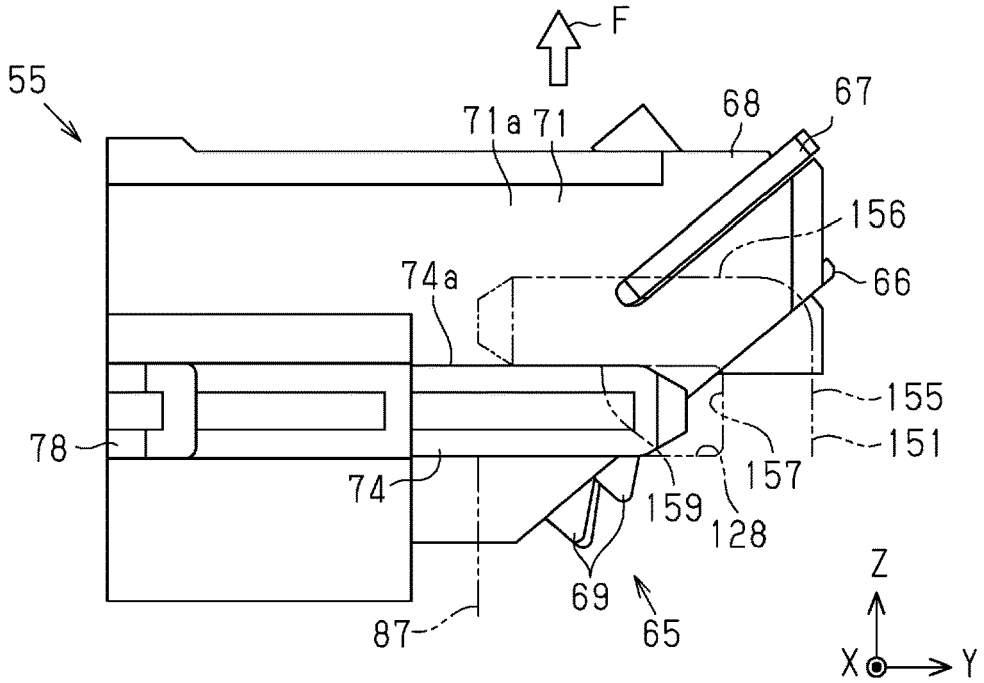
FIG. 11 is a side view schematically illustrating the positional relationship between a first guiding portion and a holder in a mounting state in the first embodiment.
Figure 12:
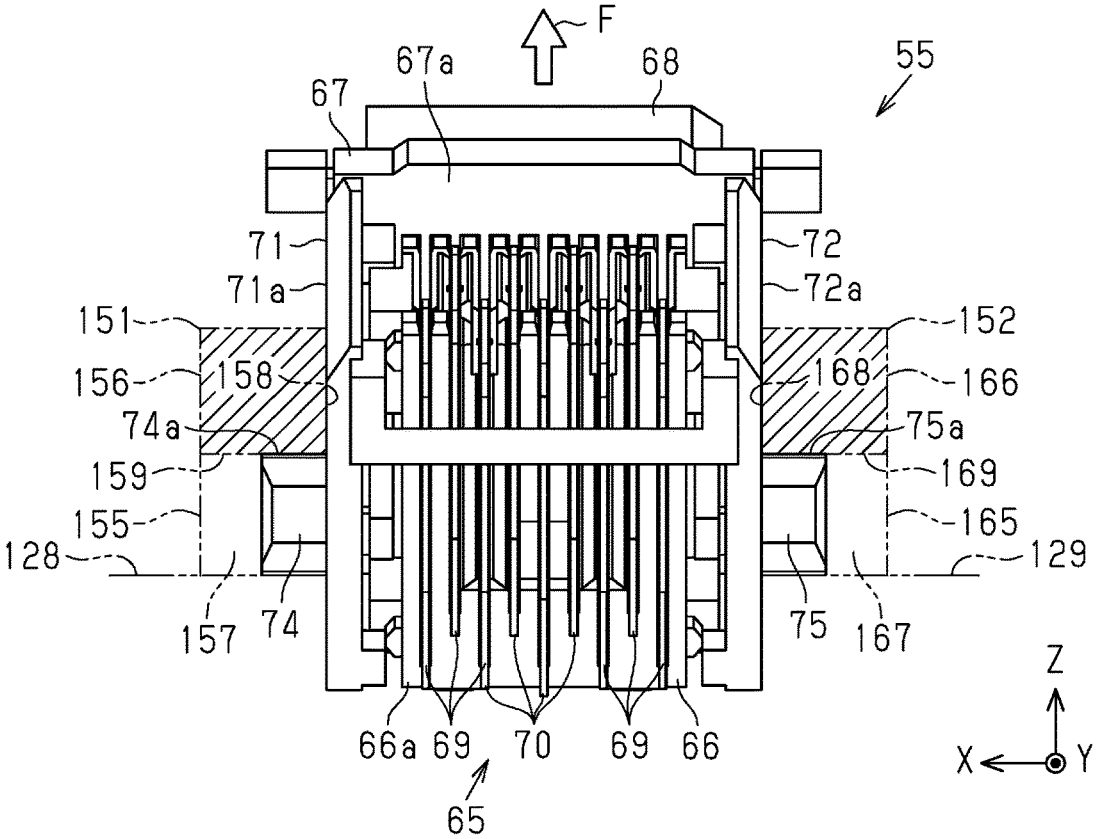
FIG. 12 is a front view schematically illustrating the positional relationship between the first guiding portion and a second guiding portion and the holder in the mounting state in the first embodiment.

As illustrated in FIGS. 11 and 12, in the cartridge 13 in the mounting state, the first guiding portion 151 is positioned in the +X direction relative to the first holder side wall portion 71. The second guiding portion 152 is positioned in the −X direction relative to the second holder side wall portion 72. Misalignment of the cartridge side terminal 144 in the +X direction relative to the apparatus side terminal 69 is regulated by the contact between the first inside surface 158 and the first outside surface 71*a*. M is alignment of the cartridge side terminal 144 in the −X direction relative to the apparatus side terminal 69 is regulated by the contact between the second inside surface 168 and the second outside surface 72*a*. In FIG. 12, the part corresponding to the first extending portion and the part corresponding to the second extending portion are hatched.

In the cartridge 13 in the mounting state, the first projection-shaped portion 74 is inserted in the first insertion recessed portion 157 and the second projection-shaped portion 75 is inserted in the second insertion recessed portion 167. Misalignment of the apparatus side terminal 69 in the −Z direction relative to the cartridge side terminal 144 is regulated by the contact between the first upper wall 128 and the first projection-shaped portion 74 and the contact between the second upper wall 129 and the second projection-shaped portion 75.

In the configuration in which the apparatus side terminal 69 and the cartridge side terminal 144 are in contact with each other on the inclined virtual plane 150, a force F to displace the holder 68 in the +Z direction acts on the apparatus side terminal portion 55 as a result of the contact between the apparatus side terminal 69 and the cartridge side terminal 144. In other words, a force F to displace the apparatus side terminal 69 in the +Z direction relative to the cartridge side terminal 144 acts on the apparatus side terminal portion 55. Misalignment of the apparatus side terminal 69 in the +Z direction relative to the cartridge side terminal 144 is regulated by the contact between the first lower side surface 159 and the first upper side surface 74*a* and the contact between the second lower side surface 169 and the second upper side surface 75*a*.

By the misalignment of the cartridge side terminal 144 relative to the apparatus side terminal 69 being regulated as described above, a state is maintained where the apparatus side terminal 69 of the apparatus side terminal group 65 and the cartridge side terminal 144 of the cartridge side terminal group 142 are correctly in contact with each other.

Effects of the first embodiment will be described.

(1) The first extending portion 156 is affected by the deformation of the second wall 82 that is entailed by the pressurization of the pressurization chamber 99 via the first upper wall 128 and the first protruding portion 155. The second extending portion 166 is affected by the deformation of the second wall 82 that is entailed by the pressurization of the pressurization chamber 99 via the second upper wall 129 and the second protruding portion 165. Accordingly, it becomes difficult to be affected by the deformation of the second wall 82 constituting the pressurization chamber 99. In other words, the relative positions of the circuit substrate 140 and the first extending portion 156 and the relative positions of the circuit substrate 140 and the second extending portion 166 are unlikely to change even when the case 80 is deformed due to the pressurization of the pressurization chamber 99. As a result, the contact between the apparatus side terminal 69 and the cartridge side terminal 144 can be easily maintained at a correct position, and thus it is possible to suppress the occurrence of a contact failure between the apparatus side terminal 69 and the cartridge side terminal 144. In addition, since the occurrence of a contact failure between the apparatus side terminal 69 and the cartridge side terminal 144 is suppressed, it is possible to reduce an error in the result of remaining ink amount calculation by the control unit 38 or the like.

(2) The first lower side surface 159 as a part of the first cartridge side contact portion is provided in the −Z direction of the first extending portion 156. The second lower side surface 169 as a part of the second cartridge side contact portion is provided in the −Z direction of the second extending portion 166. With such a configuration, Z-direction displacement of the apparatus side terminal 69 and the cartridge side terminal 144 can be suppressed. Specifically, it is possible to suppress +Z-direction displacement of the apparatus side terminal 69 relative to the cartridge side terminal 144. As a result, it is possible to suppress a contact failure based on Z-direction misalignment. Such a contact failure can be suppressed in the mounting process in which the cartridge 13 is mounted and the mounting state of the cartridge 13 alike.

(3) The first inside surface 158 as a part of the first cartridge side contact portion is provided in the −X direction of the first extending portion 156. The second inside surface 168 as a part of the second cartridge side contact portion is provided in the +X direction of the second extending portion 166. With such a configuration, it is possible to suppress X-direction displacement of the cartridge side terminal 144 relative to the apparatus side terminal 69. As a result, it is possible to suppress a contact failure based on X-direction misalignment. The contact failure can be suppressed in the mounting process in which the cartridge 13 is mounted and the mounting state of the cartridge 13 alike.

(4) The first inside surface 158 and the first lower side surface 159 constituting the first cartridge side contact portion are provided in the −X direction and the −Z direction of the first extending portion 156, respectively. The second inside surface 168 and the second lower side surface 169 constituting the second cartridge side contact portion are provided in the +X direction and the −Z direction of the second extending portion 166, respectively. With such a configuration, it is possible to suppress a contact failure based on X-direction and Z-direction misalignment of the apparatus side terminal 69 and the cartridge side terminal 144 with the first extending portion 156 and the second extending portion 166.

(5) Each of the first extending portion 156 and the second extending portion 166 has a quadrangular sectional shape. With such a configuration, the mechanical strength of the first extending portion 156 and the mechanical strength of the second extending portion 166 can be enhanced. As a result, it is possible to suppress deformation of the first extending portion 156 and the second extending portion 166 in suppressing misalignment of the apparatus side terminal 69 and the cartridge side terminal 144.

(6) In this configuration, the contact between the holder 68 and the first extending portion 156 is surface contact and the contact between the holder 68 and the second extending portion 166 is surface contact. With such a configuration, it is possible to effectively suppress deformation of the first extending portion 156 and the second extending portion 166 in suppressing misalignment of the apparatus side terminal 69 and the cartridge side terminal 144.

Second Embodiment

A cartridge and a liquid ejecting system of a second embodiment will be described with reference to the drawings. In the second embodiment, parts different from the first embodiment will be described in detail and the same parts as in the first embodiment will be denoted by the same reference numerals with detailed description omitted.

Figure 13:
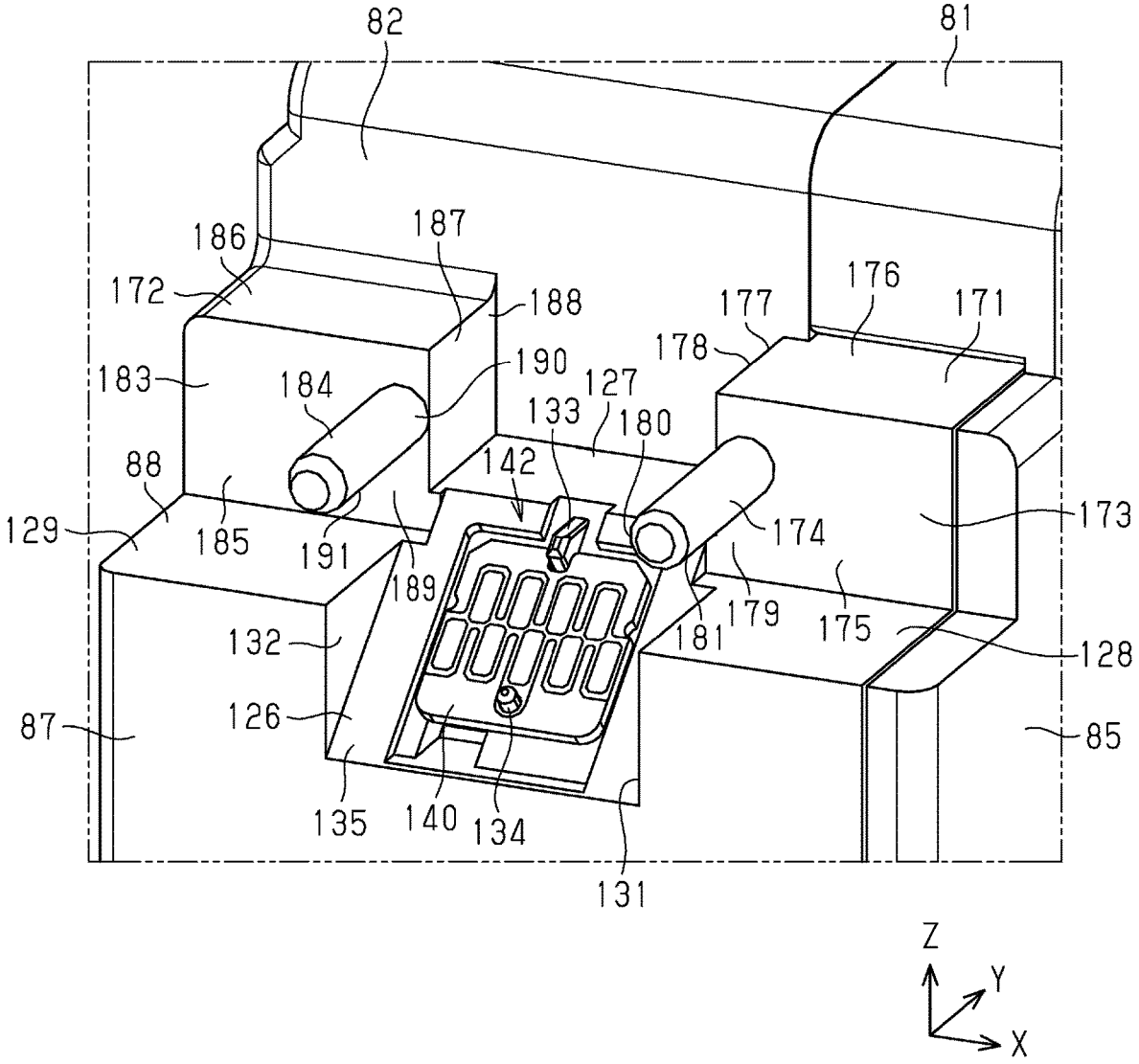
FIG. 13 is a perspective view illustrating a terminal disposition wall portion in a second embodiment.

As illustrated in FIG. 13, the terminal disposition wall portion 88 has a first guiding portion 171 and a second guiding portion 172. The first guiding portion 171 and the second guiding portion 172 are provided so as to face each other in the X direction with the cartridge side terminal group 142 in between when the cartridge side terminal group 142 is viewed from the −Y direction toward the +Y direction. In the mounting process in which the cartridge 13 is mounted, the first guiding portion 171 and the second guiding portion 172 guide the cartridge 13 to the contact position where the apparatus side terminal group 65 and the cartridge side terminal group 142 correctly come into contact with each other.

The first guiding portion 171 is formed on the first upper wall 128. The first guiding portion 171 has a first protruding portion 173 and a first extending portion 174. The first protruding portion 173 extends in the +Z direction from a +Y-direction part of the first upper wall 128. The first protruding portion 173 is formed in a substantially rectangular parallelepiped shape. The first protruding portion 173 has a first front side wall 175, a first coupling wall 176, and a first inside wall 177.

The first front side wall 175 is a wall including the X direction and the Z direction. The first front side wall 175 is positioned in the +Y direction of the front wall 87 and in the −Y direction of the second wall 82. The first coupling wall 176 is a wall including the X direction and the Y direction. The first coupling wall 176 is positioned in the +Z direction of the first upper wall 128 and in the −Z direction of the first wall 81. The first coupling wall 176 couples the end portion of the first front side wall 175 in the +Z direction to the second wall 82. The first inside wall 177 is a wall including the Y direction and the Z direction. The first inside wall 177 couples the −X-direction end portion of the first front side wall 175 to the second wall 82 and the coupling wall 127. The first inside wall 177 couples the −X-direction end portion of the first coupling wall 176 to the second wall 82 and the coupling wall 127.

The first protruding portion 173 has a first inside surface 178. The first inside surface 178 constitutes the first cartridge side contact portion. The first inside surface 178 is a part that is capable of coming into contact with the first holder side wall portion 71 of the holder 68 from the +X direction in the mounting process in which the cartridge 13 is mounted and capable of being in contact with the first holder side wall portion 71 of the holder 68 from the +X direction in the mounting state of the cartridge 13. The first inside surface 178 is a surface including the Y direction and the Z direction. The first inside surface 178 is formed on the first inside wall 177. The first inside surface 178 is provided in the −X direction in the first protruding portion 173. The first inside surface 178 comes into surface contact with the first outside surface 71*a* when the first inside surface 178 comes into contact with the first holder side wall portion 71.

The first extending portion 174 is provided at a position closer to the −X-direction end portion of the first front side wall 175 than the fifth wall 85. The first extending portion 174 extends in the −Y direction from the first front side wall 175. The first extending portion 174 has a circular sectional shape. A first insertion recessed portion 179 is formed in the terminal disposition wall portion 88 by the first upper wall 128, the first protruding portion 173, and the first extending portion 174. In the mounting process in which the cartridge 13 is mounted, the first projection-shaped portion 74 of the holder 68 illustrated in FIGS. 3 and 4 is inserted into the first insertion recessed portion 179. The first insertion recessed portion 179 is open in the +X direction and the −X direction in addition to the −Y direction.

The first extending portion 174 has a first inner edge portion 180 and a first lower edge portion 181. The first inner edge portion 180 and the first lower edge portion 181 constitute the first cartridge side contact portion. The first inner edge portion 180 is a part that is capable of coming into contact with the first holder side wall portion 71 of the holder 68 from the +X direction in the mounting process in which the cartridge 13 is mounted and capable of being in contact with the first holder side wall portion 71 of the holder 68 from the +X direction in the mounting state of the cartridge 13. An edge positioned in the −X direction in the section of the first extending portion 174 in a direction orthogonal to the Y direction constitutes the first inner edge portion 180. The first inner edge portion 180 extends along the Y direction. The first inner edge portion 180 is provided in the −X direction in the first extending portion 174.

The first lower edge portion 181 is a part that is capable of coming into contact with the first projection-shaped portion 74 of the holder 68 from the +Z direction in the mounting process in which the cartridge 13 is mounted and capable of being in contact with the first projection-shaped portion 74 of the holder 68 from the +Z direction in the mounting state of the cartridge 13. An edge positioned in the −Z direction in the section of the first extending portion 174 in the direction orthogonal to the Y direction constitutes the first lower edge portion 181. The first lower edge portion 181 extends along the Y direction. The first lower edge portion 181 is provided in the −Z direction in the first extending portion 174.

The second guiding portion 172 is formed on the second upper wall 129. The second guiding portion 172 has a second protruding portion 183 and a second extending portion 184. The second protruding portion 183 extends in the +Z direction from a +Y-direction part of the second upper wall 129. The second protruding portion 183 is formed in a substantially rectangular parallelepiped shape. The second protruding portion 183 has a second front side wall 185, a second coupling wall 186, and a second inside wall 187.

The second front side wall 185 is a wall including the X direction and the Z direction. The second front side wall 185 is positioned in the +Y direction of the front wall 87 and in the −Y direction of the second wall 82. The second coupling wall 186 is a wall including the X direction and the Y direction. The second coupling wall 186 is positioned in the +Z direction of the second upper wall 129 and in the −Z direction of the second wall 82. The second coupling wall 186 couples the end portion of the second front side wall 185 in the +Z direction to the second wall 82. The second inside wall 187 is a wall including the Y direction and the Z direction. The second inside wall 187 couples the +X-direction end portion of the second front side wall 185 to the second wall 82 and the coupling wall 127. The second inside wall 187 couples the +X-direction end portion of the second coupling wall 186 to the second wall 82 and the coupling wall 127.

The second protruding portion 183 has a second inside surface 188. The second inside surface 188 constitutes the second cartridge side contact portion. The second inside surface 188 is a part that is capable of coming into contact with the second holder side wall portion 72 of the holder 68 from the −X direction in the mounting process in which the cartridge 13 is mounted and capable of being in contact with the second holder side wall portion 72 of the holder 68 from the −X direction in the mounting state of the cartridge 13. The second inside surface 188 is a surface including the Y direction and the Z direction. The second inside surface 188 is formed on the second inside wall 187. The second inside surface 188 is provided in the +X direction in the second protruding portion 183. The second inside surface 188 comes into surface contact with the second outside surface 72*a* when the second inside surface 188 comes into contact with the second holder side wall portion 72.

The second extending portion 184 is provided at a position closer to the +X-direction end portion of the second front side wall 185 than the sixth wall 86. The second extending portion 184 extends in the −Y direction from the second front side wall 185. The second extending portion 184 has a circular sectional shape. A second insertion recessed portion 189 is formed in the terminal disposition wall portion 88 by the second upper wall 129, the second protruding portion 183, and the second extending portion 184. In the mounting process in which the cartridge 13 is mounted, the second projection-shaped portion 75 of the holder 68 illustrated in FIGS. 3 and 4 is inserted into the second insertion recessed portion 189. The second insertion recessed portion 189 is open in the +X direction and the −X direction in addition to the −Y direction.

The second extending portion 184 has a second inner edge portion 190 and a second lower edge portion 191. The second inner edge portion 190 and the second lower edge portion 191 constitute the second cartridge side contact portion. The second inner edge portion 190 is a part that is capable of coming into contact with the second holder side wall portion 72 of the holder 68 from the −X direction in the mounting process in which the cartridge 13 is mounted and capable of being in contact with the second holder side wall portion 72 of the holder 68 from the −X direction in the mounting state of the cartridge 13. An edge positioned in the +X direction in the section of the second extending portion 184 in the direction orthogonal to the Y direction constitutes the second inner edge portion 190. The second inner edge portion 190 extends along the Y direction. The second inner edge portion 190 is provided in the +X direction in the second extending portion 184.

The second lower edge portion 191 is a part that is capable of coming into contact with the second projection-shaped portion 75 of the holder 68 from the +Z direction in the mounting process in which the cartridge 13 is mounted and capable of being in contact with the second projection-shaped portion 75 of the holder 68 from the +Z direction in the mounting state of the cartridge 13. An edge positioned in the −Z direction in the section of the second extending portion 184 in the direction orthogonal to the Y direction constitutes the second lower edge portion 191. The second lower edge portion 191 extends along the Y direction. The second lower edge portion 191 is provided in the −Z direction in the second extending portion 184.

The action of the cartridge 13 configured as described above will be described.

Figure 14:
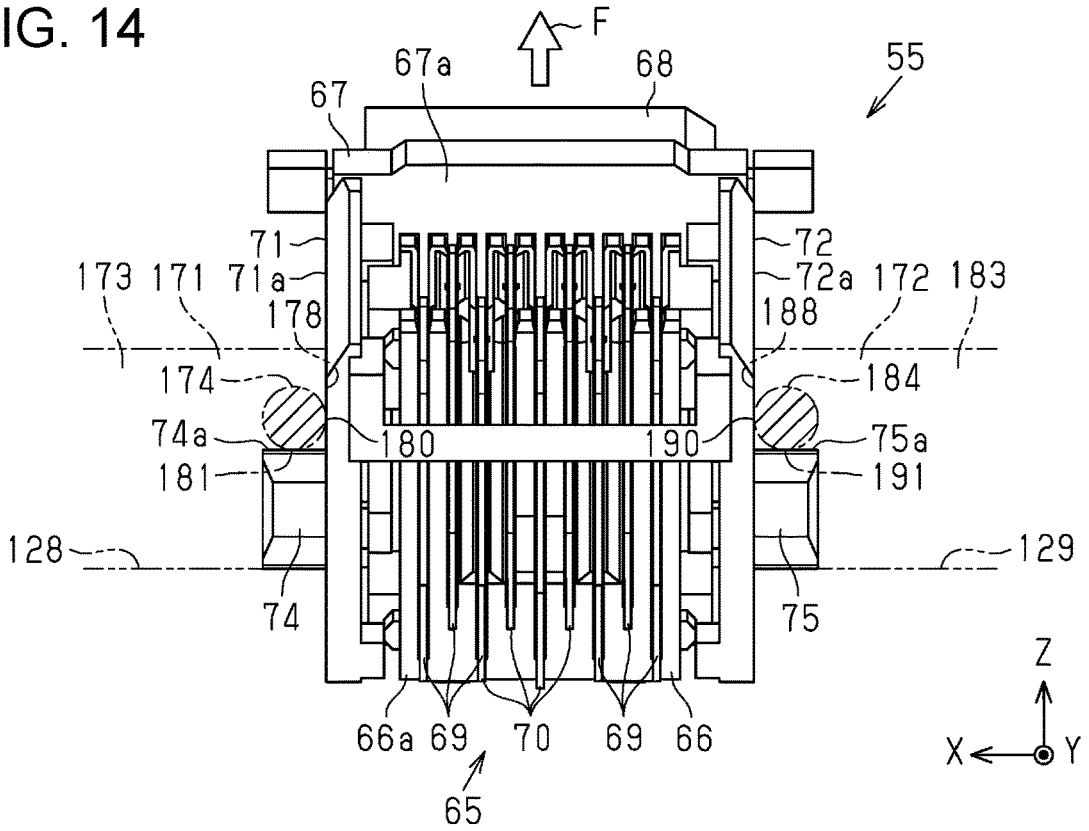
FIG. 14 is a front view schematically illustrating the positional relationship between first and second guiding portions and a holder in the mounting state in the second embodiment.

As illustrated in FIG. 14, misalignment of the cartridge side terminal 144 in the +X direction relative to the apparatus side terminal 69 is regulated by the contact between the first inside surface 178 and the first outside surface 71*a* and the contact between the first inner edge portion 180 and the first outside surface 71*a*. Misalignment of the cartridge side terminal 144 in the −X direction relative to the apparatus side terminal 69 is regulated by the contact between the second inside surface 188 and the second outside surface 72*a* and the contact between the second inner edge portion 190 and the second outside surface 72*a*. In addition, misalignment based on the force F to displace the holder 68 in the +Z direction, that is, misalignment of the apparatus side terminal 69 in the +Z direction relative to the cartridge side terminal 144 is regulated by the contact between the first lower edge portion 181 and the first upper side surface 74*a* and the contact between the second lower edge portion 191 and the second upper side surface 75*a*. In FIG. 14, the part corresponding to the first extending portion and the part corresponding to the second extending portion are hatched.

Effects of the second embodiment will be described.

(7) The first extending portion 174 is affected by the deformation of the second wall 82 that is entailed by the pressurization of the pressurization chamber 99 via the first protruding portion 173. The second extending portion 184 is affected by the deformation of the second wall 82 that is entailed by the pressurization of the pressurization chamber 99 via the second protruding portion 183. Accordingly, the relative positions of the circuit substrate 140 and the first extending portion 174 and the relative positions of the circuit substrate 140 and the second extending portion 184 are unlikely to change even when the case 80 is deformed due to the pressurization of the pressurization chamber 99. As a result, it is possible to suppress the occurrence of a contact failure between the apparatus side terminal 69 and the cartridge side terminal 144.

(8) The first lower edge portion 181 as a part of the first cartridge side contact portion is provided in the −Z direction of the first extending portion 174. The second lower edge portion 191 as a part of the second cartridge side contact portion is provided in the −Z direction of the second extending portion 184. With such a configuration, it is possible to suppress a contact failure based on Z-direction misalignment of the apparatus side terminal 69 and the cartridge side terminal 144.

(9) The first inner edge portion 180 as a part of the first cartridge side contact portion is provided in the −X direction of the first extending portion 174. The second inner edge portion 190 as a part of the second cartridge side contact portion is provided in the +X direction of the second extending portion 184. With such a configuration, it is possible to suppress X-direction displacement of the cartridge side terminal 144 relative to the apparatus side terminal 69.

(10) The first inner edge portion 180 and the first lower edge portion 181 constituting the first cartridge side contact portion are provided in the −X direction and the −Z direction of the first extending portion 174, respectively. The second inner edge portion 190 and the second lower edge portion 191 constituting the second cartridge side contact portion are provided in the +X direction and the −Z direction of the second extending portion 184, respectively. With such a configuration, it is possible to suppress a contact failure based on X-direction and Z-direction misalignment of the apparatus side terminal 69 and the cartridge side terminal 144 with the first extending portion 174 and the second extending portion 184.

(11) Each of the first extending portion 174 and the second extending portion 184 has a circular sectional shape. With such a configuration, even when an intensive mechanical load acts on the first inner edge portion 180 as a result of the contact between the first inner edge portion 180 and the first outside surface 71*a*, the mechanical load can be efficiently dispersed. Likewise, even when an intensive mechanical load acts on the second inner edge portion 190 as a result of the contact between the second inner edge portion 190 and the second outside surface 72*a*, the mechanical load can be efficiently dispersed.

(12) The cartridge 13 has the first inside surface 178 in the −X direction of the first protruding portion 173 as the first cartridge side contact portion. With such a configuration, it is possible to reduce the mechanical load itself that is applied from the first outside surface 71*a* to the first extending portion 174. As a result, it is possible to effectively suppress a contact failure based on X-direction misalignment of the apparatus side terminal 69 and the cartridge side terminal 144.

(13) The cartridge 13 has the second inside surface 188 in the +X direction of the second protruding portion 183 as the second cartridge side contact portion. With such a configuration, it is possible to reduce the mechanical load itself that is applied from the second outside surface 72*a* to the second extending portion 184. As a result, it is possible to effectively suppress a contact failure based on X-direction misalignment of the apparatus side terminal 69 and the cartridge side terminal 144.

Third Embodiment

A cartridge and a liquid ejecting system of the third embodiment will be described with reference to FIG. 15.

The cartridge of the third embodiment is different from the cartridge of the first embodiment in that X-direction misalignment of the apparatus side terminal 69 and the cartridge side terminal 144 is regulated only by the first protruding portion and the second protruding portion. Accordingly, in the third embodiment, parts different from the first embodiment will be described in detail and the same parts as in the first embodiment will be denoted by the same reference numerals with detailed description omitted. In FIG. 15, the part corresponding to the first extending portion and the part corresponding to the second extending portion are hatched.

Figure 15:
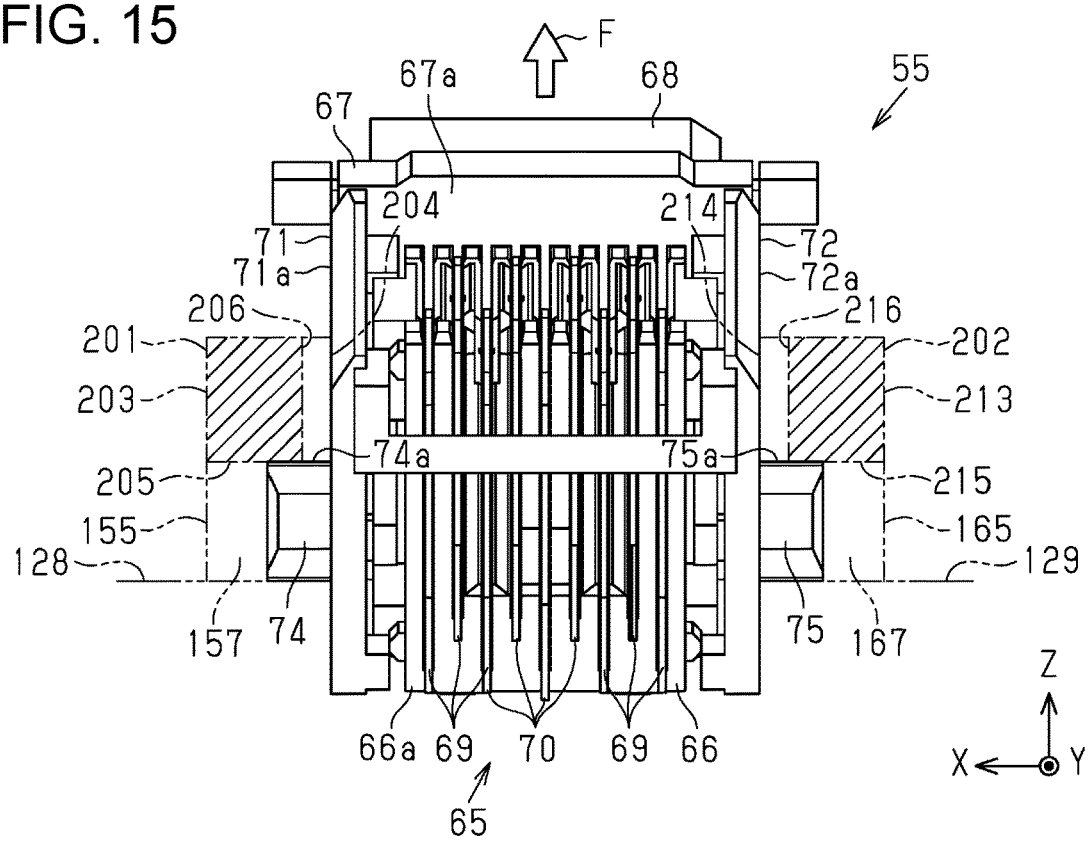
FIG. 15 is a front view schematically illustrating the positional relationship between first and second guiding portions and a holder in the mounting state in a third embodiment.
Figure 16:
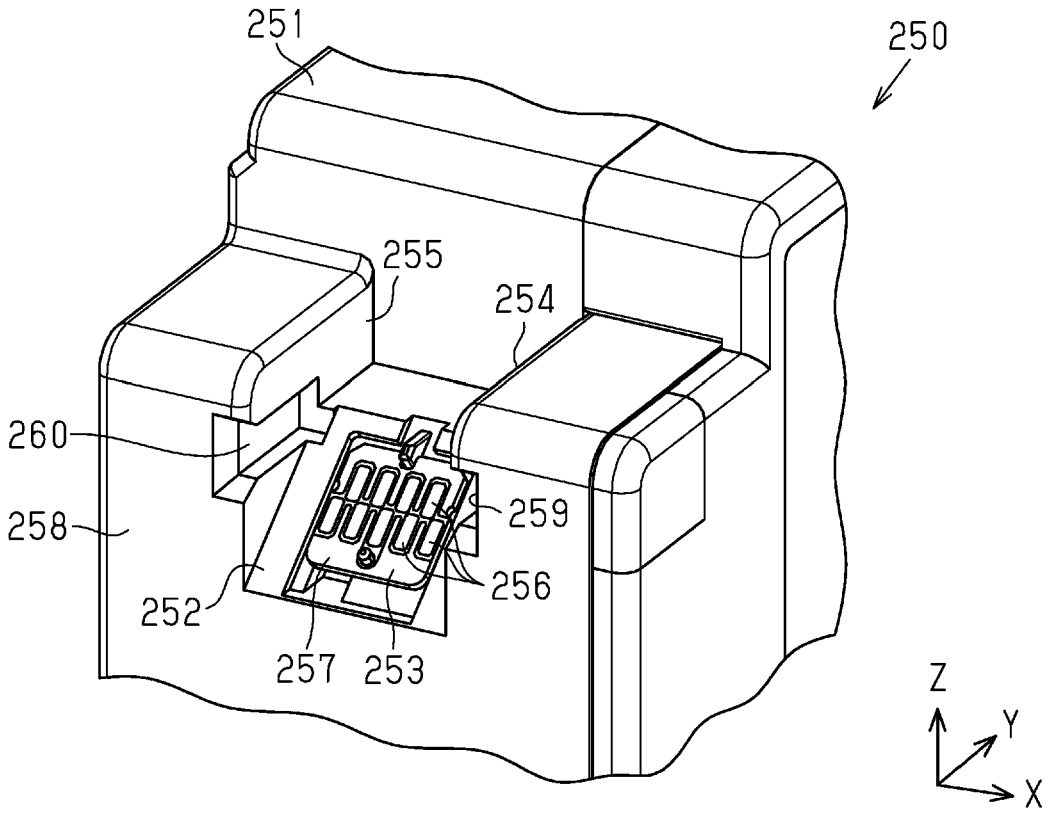
FIG. 16 is a perspective view illustrating a terminal disposition wall portion in an example according to the related art.

As illustrated in FIG. 15, the terminal disposition wall portion 88 has a first guiding portion 201 and a second guiding portion 202. The first guiding portion 201 and the second guiding portion 202 are provided so as to face each other in the X direction with the cartridge side terminal group 142 in between when the cartridge side terminal group 142 is viewed from the −Y direction toward the +Y direction. In the mounting process in which the cartridge 13 is mounted, the first guiding portion 201 and the second guiding portion 202 guide the cartridge 13 to the contact position where the apparatus side terminal group 65 and the cartridge side terminal group 142 correctly come into contact with each other.

The first guiding portion 201 has the first protruding portion 155 and a first extending portion 203. The first protruding portion 155 has a first inside surface 204. The first inside surface 204 is a surface including the Y direction and the Z direction. The first inside surface 204 is the first cartridge side contact portion that is provided in the −X direction in the first protruding portion 155. The first extending portion 203 extends in the −Y direction from the end portion of the first protruding portion 155 in the +Z direction. The first extending portion 203 has a polygonal sectional shape. In the present embodiment, the first extending portion 203 has a quadrangular sectional shape. The first extending portion 203 has a first lower side surface 205 and a first separated inside surface 206. The first lower side surface 205 is a part that is capable of coming into contact with a part of the first projection-shaped portion 74 of the holder 68 from the +Z direction in the mounting process in which the cartridge 13 is mounted and capable of being in contact with a part of the first projection-shaped portion 74 of the holder 68 from the +Z direction in the mounting state of the cartridge 13. The first lower side surface 205 is a surface including the X direction and the Y direction. The first lower side surface 205 is the first cartridge side contact portion that is provided in the −Z direction in the first extending portion 203. The first separated inside surface 206 is a surface extending in the Y direction. The first separated inside surface 206 is separated from the first holder side wall portion 71 of the holder 68 in the mounting process in which the cartridge 13 is mounted and the mounting state of the cartridge 13.

The second guiding portion 202 has the second protruding portion 165 and a second extending portion 213. The second protruding portion 165 has a second inside surface 214. The second inside surface 214 is a surface including the Y direction and the Z direction. The second inside surface 214 is the second cartridge side contact portion that is provided in the −X direction in the second protruding portion 165. The second extending portion 213 extends in the −Y direction from the end portion of the second protruding portion 165 in the +Z direction. The second extending portion 213 has a polygonal sectional shape. In the present embodiment, the second extending portion 213 has a quadrangular sectional shape. The second extending portion 213 has a second lower side surface 215 and a second separated inside surface 216. The second lower side surface 215 is a part that is capable of coming into contact with a part of the second projection-shaped portion 75 of the holder 68 from the +Z direction in the mounting process in which the cartridge 13 is mounted and capable of being in contact with a part of the second projection-shaped portion 75 of the holder 68 from the +Z direction in the mounting state of the cartridge 13. The second lower side surface 215 is a surface including the X direction and the Y direction. The second lower side surface 215 is the second cartridge side contact portion that is provided in the −Z direction in the second extending portion 213. The second separated inside surface 216 is a surface extending in the Y direction. The second separated inside surface 216 is separated from the second holder side wall portion 72 of the holder 68 in the mounting process in which the cartridge 13 is mounted and the mounting state of the cartridge 13.

The action of the cartridge 13 configured as described above will be described.

As illustrated in FIG. 15, misalignment of the cartridge side terminal 144 in the +X direction relative to the apparatus side terminal 69 is regulated by the contact between the first inside surface 204 and the first outside surface 71*a*. Misalignment of the cartridge side terminal 144 in the −X direction relative to the apparatus side terminal 69 is regulated by the contact between the second inside surface 214 and the second outside surface 72*a*. In addition, misalignment based on the force F to displace the holder 68 in the +Z direction, that is, misalignment of the apparatus side terminal 69 in the +Z direction relative to the cartridge side terminal 144 is regulated by the contact between the first lower side surface 205 and the first upper side surface 74*a* and the contact between the second lower side surface 215 and the second upper side surface 75*a*.

Effects of the third embodiment will be described.

(14) The relative positions of the circuit substrate 140 and the first extending portion 203 and the relative positions of the circuit substrate 140 and the second extending portion 213 are unlikely to change even when the case 80 is deformed due to the pressurization of the pressurization chamber 99. As a result, it is possible to suppress the occurrence of a contact failure between the apparatus side terminal 69 and the cartridge side terminal 144.

(15) The first lower side surface 205 as one first cartridge side contact portion is provided in the −Z direction of the first extending portion 203. The second lower side surface 215 as one second cartridge side contact portion is provided in the −Z direction of the second extending portion 213. With such a configuration, it is possible to suppress a contact failure based on Z-direction misalignment of the apparatus side terminal 69 and the cartridge side terminal 144.

(16) The first inside surface 204 as one first cartridge side contact portion is provided in the −X direction of the first protruding portion 155. The second inside surface 214 as one second cartridge side contact portion is provided in the +X direction of the second protruding portion 165. With such a configuration, it is possible to suppress X-direction displacement of the cartridge side terminal 144 relative to the apparatus side terminal 69.

The above embodiments can be modified as follows in being implemented. The above embodiments and the following modification examples can be implemented in combination with each other within a technically consistent range.

- In the first embodiment, the sectional shapes of the first extending portion 156 and the second extending portion 166 are not limited to a quadrangular shape. At least one of the sectional shapes of the first extending portion 156 and the second extending portion 166 may be another polygonal shape, a circular shape, or an oval shape. When the sectional shape is a polygonal shape, a configuration in which surface contact with the holder 68 is performed may be adopted.
- In the second embodiment, the sectional shapes of the first extending portion 174 and the second extending portion 184 are not limited to a circular shape. At least one of the sectional shapes of the first extending portion 174 and the second extending portion 184 may be a polygonal shape or an oval shape. When the sectional shape is a polygonal shape, a configuration in which surface contact with the holder 68 is performed may be adopted.
- In the third embodiment, the sectional shapes of the first extending portion 203 and the second extending portion 213 are not limited to a quadrangular shape. At least one of the sectional shapes of the first extending portion 203 and the second extending portion 213 may be another polygonal shape, a circular shape, or an oval shape. When the sectional shape is a polygonal shape, a configuration in which surface contact with the holder 68 is performed may be adopted.
- In the first to third embodiments, the cartridge 13 may have a coupling portion bridged between the first extending portion 156, 174, 203 and the second extending portion 166, 184, 213 and integrally coupling the first extending portion 156, 174, 203 and the second extending portion 166, 184, 213. The coupling portion is provided at a position where the cartridge mounting portion 28 is not interfered with in the mounting process in which the cartridge 13 is mounted and the mounting state of the cartridge 13. With such a configuration, the relative positions of the circuit substrate 140 and the first extending portion 156, 174, 203 and the relative positions of the circuit substrate 140 and the second extending portion 166, 184, 213 are unlikely to change even when the case 80 is deformed due to the pressurization of the pressurization chamber 99.
- In the first and second embodiments, the first cartridge side contact portion may be provided only in the first extending portion 156, 174, 203.
- In the first and second embodiments, the second cartridge side contact portion may be provided only in the second extending portion 166, 184, 213.
- In the first to third embodiments, the plurality of cartridge side terminals 144 are not limited to the configuration in which the plurality of cartridge side terminals 144 are disposed in the terminal disposition wall portion 88 by the circuit substrate 140. The plurality of cartridge side terminals 144 may be directly formed on the terminal disposition wall portion 88. The plurality of cartridge side terminals 144 may be disposed in the terminal disposition wall portion 88 by the plurality of cartridge side terminals 144 being formed on the surface of a flexible film-shaped member and the member being attached to the terminal disposition wall portion 88.
- In the first to third embodiments, the contact between the first apparatus side contact portion and the first cartridge side contact portion is not limited to surface contact. For example, the contact may be point contact or contact at a plurality of places. The contact between the second apparatus side contact portion and the second cartridge side contact portion is not limited to surface contact and may be point contact or contact at a plurality of places.

The liquid ejecting apparatus 12 may eject or discharge a liquid other than ink. The state of the liquid that is discharged from the liquid ejecting apparatus as a minute amount of droplets includes a granular state, a tear-like state, and a tailed thread-like state. Here, the liquid may be any material that can be ejected from the liquid ejecting apparatus. For example, the liquid may be in a state where the substance is in a liquid phase and includes fluids such as high-viscosity liquids, low-viscosity liquids, sol, gel water, other inorganic solvents, organic solvents, solutions, liquid resins, liquid metals, and metal melts. The liquid includes not only a liquid as one state of a substance but also, for example, one in which the particles of a functional material made of a solid material such as a pigment and metal particles are dissolved, dispersed, or mixed in a solvent. Typical examples of the liquid include a liquid crystal and the ink described in the above embodiments. Here, the ink includes general water-based and oil-based inks and various liquid compositions such as gel and hot melt inks. Specific examples of the liquid ejecting apparatus include an apparatus ejecting a liquid containing a dispersed or dissolved material such as an electrode material and a color material used in liquid crystal display manufacturing, electroluminescence display manufacturing, surface emitting display manufacturing, color filter manufacturing, or the like. The liquid ejecting apparatus may be an apparatus ejecting biological organic matter used for biochip manufacturing, an apparatus used as a precision pipette and ejecting a sample liquid, a textile printing apparatus, a micro dispenser, or the like. The liquid ejecting apparatus may eject lubricating oil in a pinpoint manner onto a precision machine such as a watch and a camera and may eject a transparent resin liquid such as an ultraviolet curable resin onto a substrate in order to form, for example, a micro hemispherical lens or an optical lens used for an optical communication element. The liquid ejecting apparatus may eject an etching solution such as acid and alkali in order to etch a substrate or the like.

The technical idea that can be grasped from the embodiments and the modification examples will be described.

A cartridge is mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge includes a plurality of cartridge side terminals configured to be electrically coupled to the plurality of apparatus side terminals, a pressurization chamber supplied with the pressurized fluid, a terminal disposition wall portion where the plurality of cartridge side terminals are disposed, a first cartridge side contact portion configured to come into contact with the first apparatus side contact portion, and a second cartridge side contact portion configured to come into contact with the second apparatus side contact portion. A plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction. The pressurization chamber has a plurality of walls including a first wall positioned in the +Z direction and a second wall positioned in the −Y direction. The terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion. The first cartridge side contact portion is provided in the first extending portion. The second cartridge side contact portion is provided in the second extending portion.

According to the configuration described above, the first extending portion provided with the first cartridge side contact portion is affected by the deformation of the second wall that is entailed by the pressurization of the pressurization chamber via the terminal disposition wall portion and the first protruding portion. The second extending portion provided with the second cartridge side contact portion is affected by the deformation of the second wall that is entailed by the pressurization of the pressurization chamber via the terminal disposition wall portion and the second protruding portion. Accordingly, even when the second wall constituting the pressurization chamber is deformed, it becomes difficult to be affected by the deformation. As a result, deformation of the first cartridge side contact portion and the second cartridge side contact portion attributable to the pressurization of the pressurization chamber is suppressed, and thus it is possible to suppress the occurrence of a contact failure between the cartridge side terminal and the apparatus side terminal.

In the cartridge described above, the first cartridge side contact portion may be provided in the −Z direction of the first extending portion and the second cartridge side contact portion may be provided in the −Z direction of the second extending portion.

According to the configuration described above, it is possible to suppress the occurrence of a Z-direction contact failure between the cartridge side terminal and the apparatus side terminal.

In the cartridge described above, the first cartridge side contact portion may be provided in the −X direction of the first extending portion and the second cartridge side contact portion may be provided in the +X direction of the second extending portion.

According to the configuration described above, it is possible to suppress the occurrence of an X-direction contact failure between the cartridge side terminal and the apparatus side terminal.

In the cartridge described above, the first cartridge side contact portion may be provided in each of the −X direction and the −Z direction of the first extending portion and the second cartridge side contact portion may be provided in each of the +X direction and the −Z direction of the second extending portion.

According to the configuration described above, it is possible to suppress the occurrence of X-direction and Z-direction contact failures between the cartridge side terminal and the apparatus side terminal.

In the cartridge described above, a section of the first extending portion may have a circular shape or a polygonal shape and a section of the second extending portion may have a circular shape or a polygonal shape.

According to the configuration described above, deformation of the first cartridge side contact portion and the second cartridge side contact portion attributable to the pressurization of the pressurization chamber is effectively suppressed, and thus it is possible to effectively suppress the occurrence of a contact failure between the cartridge side terminal and the apparatus side terminal.

A cartridge is mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge includes a plurality of cartridge side terminals configured to be electrically coupled to the plurality of apparatus side terminals, a pressurization chamber supplied with the pressurized fluid, a terminal disposition wall portion where the plurality of cartridge side terminals are disposed, a first cartridge side contact portion configured to come into contact with the first apparatus side contact portion, and a second cartridge side contact portion configured to come into contact with the second apparatus side contact portion. A plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction. The pressurization chamber has a plurality of walls including a first wall positioned in the +Z direction and a second wall positioned in the −Y direction. The terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion. The first cartridge side contact portion is provided in the −X direction of the first protruding portion and in the −Z direction of the first extending portion. The second cartridge side contact portion is provided in the +X direction of the second protruding portion and in the −Z direction of the second extending portion.

According to the configuration described above, it is possible to suppress the occurrence of an X-direction contact failure between the cartridge side terminal and the apparatus side terminal with the first protruding portion and the second protruding portion. It is possible to suppress the occurrence of a Z-direction contact failure between the cartridge side terminal and the apparatus side terminal with the first extending portion and the second extending portion.

A liquid ejecting system includes a liquid ejecting apparatus and the cartridge described above. The liquid ejecting apparatus is provided, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction. The cartridge is mounted in the liquid ejecting apparatus by being moved from the +Y direction toward the −Y direction. With this configuration, the same effects as those of the cartridge described above can be obtained.

What is claimed is:

1. A cartridge mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction, the cartridge comprising:

a plurality of cartridge side terminals configured to be electrically coupled to the plurality of apparatus side terminals;

a pressurization chamber supplied with the pressurized fluid;

a terminal disposition wall portion where the plurality of cartridge side terminals are disposed;

a first cartridge side contact portion configured to come into contact with the first apparatus side contact portion; and a second cartridge side contact portion configured to come into contact with the second apparatus side contact portion, wherein a plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction, the pressurization chamber has a plurality of walls including a first wall positioned in the +Z direction and a second wall positioned in the −Y direction, the terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion, the first cartridge side contact portion is provided in the first extending portion, and the second cartridge side contact portion is provided in the second extending portion.

2. The cartridge according to claim 1, wherein the first cartridge side contact portion is provided in the −Z direction of the first extending portion, and the second cartridge side contact portion is provided in the −Z direction of the second extending portion.

3. The cartridge according to claim 1, wherein the first cartridge side contact portion is provided in the −X direction of the first extending portion, and the second cartridge side contact portion is provided in the +X direction of the second extending portion.

4. The cartridge according to claim 1, wherein the first cartridge side contact portion is provided in each of the −X direction and the −Z direction of the first extending portion, and the second cartridge side contact portion is provided in each of the +X direction and the −Z direction of the second extending portion.

5. The cartridge according to claim 1, wherein a section of the first extending portion has a circular shape or a polygonal shape, and a section of the second extending portion has a circular shape or a polygonal shape.

6. A liquid ejecting system comprising:

a liquid ejecting apparatus; and the cartridge according to claim 1, the liquid ejecting apparatus being provided, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction, the cartridge being mounted in the liquid ejecting apparatus by being moved from the +Y direction toward the −Y direction.

7. A cartridge mounted, when X, Y, and Z axes are three spatial axes mutually orthogonal to one another, X, Y, and Z directions are respectively along the X, Y, and Z axes, a +X direction is a positive direction along the X axis, a +Y direction is a positive direction along the Y axis, a +Z direction is a positive direction along the Z axis, a −X direction is a negative direction along the X axis, a −Y direction is a negative direction along the Y axis, a −Z direction is a negative direction along the Z axis, and the −Z direction is a vertical direction, by being moved from the +Y direction toward the −Y direction, in a liquid ejecting apparatus provided with a pressurization mechanism supplying a pressurized fluid to the cartridge and a holder holding a plurality of apparatus side terminals and having a first apparatus side contact portion and a second apparatus side contact portion respectively provided on a side in the +X direction and a side in the −X direction, the cartridge comprising:

a plurality of cartridge side terminals configured to be electrically coupled to the plurality of apparatus side terminals;

a pressurization chamber supplied with the pressurized fluid;

a terminal disposition wall portion where the plurality of cartridge side terminals are disposed;

a first cartridge side contact portion configured to come into contact with the first apparatus side contact portion; and a second cartridge side contact portion configured to come into contact with the second apparatus side contact portion, wherein a plurality of contact points formed on respective surfaces of the plurality of cartridge side terminals when the plurality of apparatus side terminals and the plurality of cartridge side terminals come into contact with each other are disposed so as to form an inclined surface facing a direction including a component in the −Y direction and a component in the +Z direction, the pressurization chamber has a plurality of walls including a first wall positioned in the +Z direction and a second wall positioned in the −Y direction, the terminal disposition wall portion includes a first protruding portion and a second protruding portion provided further in the −Y direction than the second wall so as to face each other in the X direction with the plurality of cartridge side terminals in between when the plurality of cartridge side terminals are viewed from the −Y direction toward the +Y direction, a first extending portion extending in the −Y direction from the first protruding portion, and a second extending portion extending in the −Y direction from the second protruding portion, the first cartridge side contact portion is provided in the −X direction of the first protruding portion and in the −Z direction of the first extending portion, and the second cartridge side contact portion is provided in the +X direction of the second protruding portion and in the −Z direction of the second extending portion.

* * * * *